US011191136B2

(12) United States Patent
Xiong et al.

(10) Patent No.: US 11,191,136 B2
(45) Date of Patent: Nov. 30, 2021

(54) LED LIGHTING SYSTEM, APPARATUS, AND DIMMING METHOD

(71) Applicant: JIAXING SUPER LIGHTING ELECTRIC APPLIANCE CO., LTD, Jiaxing (CN)

(72) Inventors: Aiming Xiong, Jiaxing (CN); Lin Zhou, Jiaxing (CN)

(73) Assignee: Jiaxing Super Lighting Electric Appliance Co., Ltd., Zhejiang (CN)

( * ) Notice: Subject to any disclaimer, the term of this patent is extended or adjusted under 35 U.S.C. 154(b) by 0 days.

(21) Appl. No.: 16/511,575

(22) Filed: Jul. 15, 2019

(65) Prior Publication Data

US 2020/0022232 A1 Jan. 16, 2020

(30) Foreign Application Priority Data

Jul. 16, 2018 (CN) ..... 201810777596.4
Jul. 11, 2019 (CN) ..... 201921080528.9

(51) Int. Cl.
*H05B 45/10* (2020.01)
*H05B 39/04* (2006.01)
*H05B 45/50* (2020.01)
*H05B 47/10* (2020.01)

(52) U.S. Cl.
CPC ..... *H05B 45/10* (2020.01); *H05B 39/048* (2013.01); *H05B 45/50* (2020.01); *H05B 47/10* (2020.01)

(58) Field of Classification Search
CPC ..... H05B 45/10; H05B 45/50; H05B 39/048; H05B 47/10; H05B 45/355; H05B 45/31
See application file for complete search history.

(56) References Cited

U.S. PATENT DOCUMENTS 6,459,919 B1 10/2002 Lys et al.
7,889,051 B1 2/2011 Bilig et al.
8,773,031 B2 7/2014 Sadwick et al.
9,084,319 B2 7/2015 Sullivan et al.
9,131,581 B1 * 9/2015 Hsia ..... H05B 45/37
9,144,127 B1 9/2015 Yu et al.
9,161,401 B1 10/2015 Melanson et al.
9,161,415 B2 10/2015 Catalano et al.
9,185,767 B2 11/2015 Zanbaghi et al.
9,192,012 B2 11/2015 Trinschek et al.
(Continued)

FOREIGN PATENT DOCUMENTS

CN 103369802 A 10/2013
CN 103561503 A 2/2014
(Continued)

*Primary Examiner* — Minh D A
(74) *Attorney, Agent, or Firm* — Muir Patent Law, PLLC

(57) ABSTRACT

An LED lighting apparatus is configured to light in response to an input power signal. The LED lighting apparatus includes a power supply module, configured to receive the input power signal in order to generate a driving power signal, and an LED module configured to light in response to the driving power signal. The power supply module comprises a demodulating circuit configured to receive the input power signal and demodulate the received input power signal, in order to generate a dimming control signal for controlling luminance of the LED module, wherein the demodulating circuit demodulates the input power signal based on a phase-cut angle of the input power signal.

46 Claims, 12 Drawing Sheets

(56) References Cited

U.S. PATENT DOCUMENTS

| | | | | |
|---|---|---|---|---|
| 9,198,250 | B2 | 11/2015 | Malyna et al. | |
| 9,210,757 | B2 | 12/2015 | Tao et al. | |
| 9,220,150 | B2 | 12/2015 | Hartmann et al. | |
| 9,258,864 | B2 | 2/2016 | Pederson et al. | |
| 9,265,112 | B2 | 2/2016 | Pederson et al. | |
| 9,265,119 | B2 | 2/2016 | Catalano et al. | |
| 9,307,619 | B2 | 4/2016 | Campbell | |
| 9,468,067 | B2 | 10/2016 | Olariu | |
| 9,544,969 | B2 | 1/2017 | Baddela et al. | |
| 9,743,467 | B2 | 8/2017 | Malyna et al. | |
| 10,051,714 | B2 | 8/2018 | Pederson | |
| 10,111,298 | B2 | 10/2018 | Mezack et al. | |
| 10,251,243 | B2 | 4/2019 | Pederson | |
| 10,292,227 | B1 | 5/2019 | Moumen | |
| 10,324,250 | B2 | 6/2019 | Krames et al. | |
| 2010/0259185 | A1* | 10/2010 | Sadwick | H05B 45/37 315/291 |
| 2011/0133655 | A1 | 6/2011 | Recker et al. | |
| 2011/0275432 | A1 | 11/2011 | Lutnick et al. | |
| 2012/0080944 | A1 | 4/2012 | Recker et al. | |
| 2012/0299500 | A1 | 11/2012 | Sadwick et al. | |
| 2013/0141010 | A1 | 6/2013 | Reed et al. | |
| 2014/0103810 | A1 | 4/2014 | Shaffer, II et al. | |
| 2014/0128941 | A1 | 5/2014 | Williams | |
| 2015/0216002 | A1* | 7/2015 | Melanson | H05B 39/04 315/250 |
| 2015/0237694 | A1* | 8/2015 | Zudrell-Koch | H05B 45/14 315/307 |
| 2015/0237695 | A1* | 8/2015 | Jelaca | H05B 45/10 315/291 |
| 2015/0237698 | A1* | 8/2015 | Takahashi | H05B 45/10 315/200 R |
| 2016/0330808 | A1* | 11/2016 | Brandt | H05B 45/37 |
| 2017/0223794 | A1* | 8/2017 | Lewis | H02M 1/081 |

FOREIGN PATENT DOCUMENTS

| | | | |
|---|---|---|---|
| CN | 204350401 | U | 5/2015 |
| CN | 105191499 | A | 12/2015 |
| CN | 105873269 | A | 8/2016 |
| CN | 103945600 | B | 9/2017 |
| CN | 105191499 | B | 9/2017 |
| CN | 107148804 | A | 9/2017 |
| CN | 104582059 | B | 10/2017 |
| CN | 103687154 | B | 11/2017 |
| CN | 104540287 | B | 11/2017 |
| CN | 105554953 | B | 11/2017 |
| CN | 107409448 | A | 11/2017 |
| CN | 206743585 | U | 12/2017 |
| CN | 206807830 | U | 12/2017 |
| CN | 104869690 | B | 3/2018 |
| CN | 105873269 | B | 5/2018 |

* cited by examiner

WF4

WF5

Lux=Lmax

WF6

Lux=Lmin

WF4

WF7

Lux=Lmin

WF8

Lux=Lmax

LED LIGHTING SYSTEM, APPARATUS, AND DIMMING METHOD

RELATED APPLICATIONS

This application claims priority to and incorporates by reference in their entirety Chinese Patent Application Nos. CN 201810777596.4, filed on Jul. 16, 2018; and CN 20191080528.9, filed on Jul. 11, 2019.

TECHNICAL FIELD

The disclosed embodiments relate to the features of light emitting diode (LED) lighting. More particularly, the disclosed embodiments describe various improvements for LED lighting systems, an LED lighting apparatus, and LED dimming method thereof.

BACKGROUND

LED lighting technology is rapidly developing to replace traditional incandescent and fluorescent lighting. LED tube lamps are mercury-free in comparison with fluorescent tube lamps that need to be filled with inert gas and mercury. Thus, it is not surprising that various types of LED lamp, such as an LED tube lamp, an LED bulb lamp, an LED filament lamp, a high power LED lamp, an integral LED lamp, etc., are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption. Therefore, when taking into account all factors, they would typically be considered as a cost effective lighting option.

In common solutions for LED lighting, an issue that has been widely discussed is about how to achieve dimming control of the luminance of an LED lamp. In current dimming techniques, a common way is to perform phase cutting to adjust the effective value, i.e., root-mean-square (RMS) value, of an input voltage for an LED lamp, in order to achieve the dimming effects. However, because such a common way of dimming control typically significantly affects or interferes with the completeness or accuracy of the waveform of the modulated input voltage, such a common way may inevitably cause problems such as lowered lighting efficiency or light-flickering of the LED lamp under this way of dimming control.

In view of above mentioned issues, an invention is disclosed herein and illustrated by its disclosed embodiments.

SUMMARY

It's specially noted that the present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and may be described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED lighting system, LED lighting apparatus, or a portion thereof.

According to certain embodiments, the disclosure presents an LED lighting system including a dimmer and at least one LED lighting apparatus. The dimmer receives input power from an external power grid and varies a phase-cut angle of the input power within a dimming phase range/interval according to a dimming signal, in order to generate a dimmer-adjusted input power. The LED lighting apparatus receives the dimmer-adjusted input power and then is driven to light according to the dimmer-adjusted input power, wherein a maximum phase-cut angle of the dimming phase range/interval is less than 90 degrees.

In some embodiments of the disclosure, upon receiving the dimmer-adjusted input power of the maximum phase-cut angle, the LED lighting apparatus is then driven to light with a maximum value or minimum value of its lighting luminance.

In some embodiments of the disclosure, the maximum phase-cut angle of the dimming phase range/interval is smaller than 45 degrees.

In some embodiments of the disclosure, the dimming phase range/interval is a phase-cut angle of between 15 and 20 degrees.

According to certain embodiments, the disclosure also presents an LED lighting apparatus including a rectifying circuit, a filtering circuit, a driving circuit, an LED module, and a demodulating circuit. The rectifying circuit is configured to receive an input power through first and second connection terminals, in order to rectify the input power and then output a rectified signal. The filtering circuit is coupled to the rectifying circuit, in order to electrically filter the rectified signal to produce a filtered signal. The driving circuit is coupled to the filtering circuit, in order to perform power conversion on the filtered signal to produce a driving power. The LED module is coupled to the driving circuit and is configured to light up and emit light according to the received driving power. The demodulating circuit is coupled to the first and second connection terminals, and is configured to obtain or extract a signal feature of the input power signal and then demodulate the signal feature in order to obtain a corresponding dimming message. The demodulating circuit then generates a dimming control signal according to the obtained dimming message and then provides the dimming control signal for the driving circuit. And the driving circuit adjusts its operation of power conversion according to the received dimming control signal, in order to change/adjust the magnitude of the driving power in response to the dimming message.

Benefits or advantages resulting from the disclosed way(s) of dimming control herein may include a benefit that dimming control is achieved while maintaining or not hindering power conversion efficiency of the LED lighting apparatus.

DETAILED DESCRIPTION

Figure 1A:
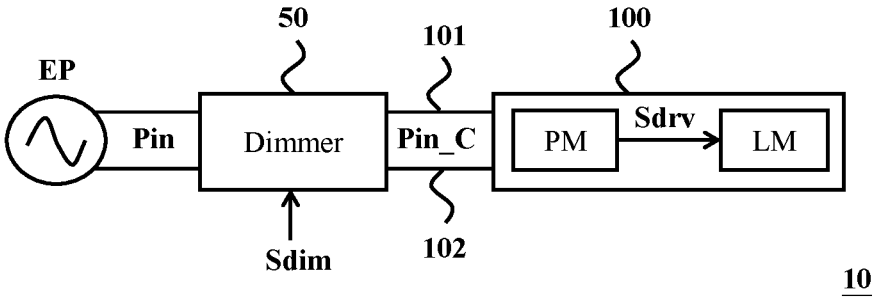
FIG. 1A is a block diagram of an LED lighting system according to an embodiment of the disclosure.

The present disclosure provides a novel LED lighting system, an LED lighting apparatus, and a dimming control method related thereto. The present disclosure will now be described in the following embodiments with reference to the drawings. The following descriptions of various embodiments of this invention are presented herein for purpose of illustration and giving examples only. It is not intended to be exhaustive or to be limited to the precise form disclosed. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

In the drawings, the size and relative sizes of components may be exaggerated for clarity. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/".

It will be understood that, although the terms first, second, third etc. may be used herein to describe various elements, components, regions, layers, or steps, these elements, components, regions, layers, and/or steps should not be limited by these terms. Unless the context indicates otherwise, these terms are only used to distinguish one element, component, region, layer, or step from another element, component, region, or step, for example as a naming convention. Thus, a first element, component, region, layer, or step discussed below in one section of the specification could be termed a second element, component, region, layer, or step in another section of the specification or in the claims without departing from the teachings of the present invention. In addition, in certain cases, even if a term is not described using "first," "second," etc., in the specification, it may still be referred to as "first" or "second" in a claim in order to distinguish different claimed elements from each other.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct connection (i.e., touching) unless the context indicates otherwise.

Embodiments described herein will be described referring to plan views and/or cross-sectional views by way of ideal schematic views. Accordingly, the exemplary views may be modified depending on manufacturing technologies and/or tolerances. Therefore, the disclosed embodiments are not limited to those shown in the views, but include modifications in configuration formed on the basis of manufacturing processes. Therefore, regions exemplified in figures may have schematic properties, and shapes of regions shown in figures may exemplify specific shapes of regions of elements to which aspects of the invention are not limited.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

Terms such as "same," "equal," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to emphasize this meaning, unless the context or other statements indicate otherwise. For example, items described as "substantially the same," "substantially equal," or "substantially planar," may be exactly the same, equal, or planar, or may be the same, equal, or planar within acceptable variations that may occur, for example, due to manufacturing processes.

Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0%-5% deviation around 0.1 and a 0% to 5% deviation around 1, especially if such deviation maintains the same effect as the listed range.

Terms such as "transistor", used herein may include, for example, a field-effect transistor (FET) of any appropriate type such as N-type metal-oxide-semiconductor field-effect transistor (MOSFET), P-type MOSFET, GaN FET, SiC FET, bipolar junction transistor (BJT), Darlington BJT, heterojunction bipolar transistor (HBT), etc.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

As used herein, items described as being "electrically connected" are configured such that an electrical signal can be passed from one item to the other. Therefore, a passive electrically conductive component (e.g., a wire, pad, internal electrical line, etc.) physically connected to a passive electrically insulative component (e.g., a prepreg layer of a printed circuit board, an electrically insulative adhesive connecting two devices, an electrically insulative underfill or mold layer, etc.) is not electrically connected to that component. Moreover, items that are "directly electrically connected," to each other are electrically connected through one or more passive elements, such as, for example, wires, pads, internal electrical lines, etc. As such, directly electrically connected components do not include components electrically connected through active elements, such as transistors or diodes, or through capacitors. Directly electrically connected elements may be directly physically connected and directly electrically connected.

Components described as thermally connected or in thermal communication are arranged such that heat will follow a path between the components to allow the heat to transfer from the first component to the second component. Simply because two components are part of the same device or board does not make them thermally connected. In general, components which are heat-conductive and directly connected to other heat-conductive or heat-generating components (or connected to those components through intermediate heat-conductive components or in such close proximity as to permit a substantial transfer of heat) will be described as thermally connected to those components, or in thermal communication with those components. On the contrary, two components with heat-insulative materials therebetween, which materials significantly prevent heat transfer between the two components, or only allow for incidental heat transfer, are not described as thermally connected or in thermal communication with each other. The terms "heat-conductive" or "thermally-conductive" do not apply to any material that provides incidental heat conduction, but are intended to refer to materials that are typically known as good heat conductors or known to have utility for transferring heat, or components having similar heat conducting properties as those materials.

Embodiments may be described, and illustrated in the drawings, in terms of functional blocks, units and/or modules. Those skilled in the art will appreciate that these blocks, units and/or modules are physically implemented by electronic (or optical) circuits such as logic circuits, discrete components, analog circuits, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules. Further, the blocks, units and/or modules of the various embodiments may be physically combined into more complex blocks, units and/or modules.

If any terms in this application conflict with terms used in any application(s) from which this application claims priority, or terms incorporated by reference into this application or the application(s) from which this application claims priority, a construction based on the terms as used or defined in this application should be applied.

It should be noted that, the following description of various embodiments of the present disclosure is described herein in order to clearly illustrate the inventive features of the present disclosure. However, it is not intended that various embodiments can only be implemented alone. Rather, it is contemplated that various of the different embodiments can be and are intended to be used together in a final product, and can be combined in various ways to achieve various final products. Thus, people having ordinary skill in the art may combine the possible embodiments together or replace the components/modules between the different embodiments according to design requirements. The embodiments taught herein are not limited to the form described in the following examples, any possible replacement and arrangement between the various embodiments are included.

FIG. 1A is a block diagram of an LED lighting system according to an embodiment of the disclosure. Referring to FIG. 1A, the LED lighting system 10 includes a dimmer 50 and an LED lighting apparatus 100 including a power supply module PM and an LED module LM.

In the LED lighting system 10 of FIG. 1A, an input terminal or input terminals of the dimmer 50 are electrically connected to an external power grid or power supply EP, in order to receive input power Pin (which can also be referred to as an input power signal Pin) from the external power grid EP. Output terminals of the dimmer 50 are electrically connected to the LED lighting apparatus 100 through first and second connection terminals 101 and 102 of the LED lighting apparatus 100, in order to transmit/provide input power Pin_C resulting from a dimming process to the LED lighting apparatus 100. Accordingly, the external power grid EP is electrically connected to the LED lighting apparatus 100 through the dimmer 50, in order to provide power for the LED lighting apparatus 100 to use. The input power Pin or Pin_C may be AC power source or DC power source; may refer to at least one of input voltage, input current, or rate of inputting electrical energy; and may be referred to as input power signal Pin or Pin_C hereinafter. Also, in the LED lighting system 10 of FIG. 1A, a power loop formed between the external power grid EP and the LED lighting apparatus 100 may be regarded or defined as comprising the power line for the LED lighting system 10 or the LED lighting apparatus 100.

The LED lighting apparatus 100 is configured to receive the input power Pin_C through its first and second connection terminals 101 and 102, and the power supply module PM is configured to generate driving power Sdry (which can also be referred to as a driving power signal Sdrv), based on the received input power Pin_C, for the LED module LM, in order for the LED module LM to light up in response to the driving power Sdrv. In various embodiments, the LED lighting apparatus 100 may comprise or be any of various types of LED lamps, such as LED spotlight, LED downlight, LED bulb lamp/light, LED track light, LED panel light, LED ceiling light, LED tube lamp/light, or LED filament lamp/light, but the present invention is not limited to any of these types. In some embodiments, the LED lighting apparatus 100 comprises an LED tube lamp, which can be referred to a ballast-compatible type (i.e., Type-A) LED tube lamp, a ballast-bypass type (i.e., Type-B) LED tube lamp, or an external driving type (i.e., Type-C) LED tube lamp.

From the perspective of overall operation of the LED lighting system 10, the dimmer 50 is configured to perform a dimming process on the received input power Pin according to a signal Sdim for dimming, hereinbelow a dimming signal Sdim, and configured to generate the input power Pin_C resulting from the dimming process (referred to herein for convenience as a dimmer-adjusted input power Pin_C). By a control interface (not illustrated) a user can cause a suitable dimming signal Sdim to be provided to the dimmer 50. The control interface may comprise or be implemented by various structures such as a switch, a knob, or a wireless signal receiver, but the present invention is not limited to any of these structures. Also, according to the chosen way to perform dimming, the dimming process may be directed to changing or adjusting any signal feature of the input power Pin, such as its phase conduction angle, frequency, amplitude, phase, or any combination thereof. The dimmer 50 includes at least one controllable electronic element, such as a bidirectional triode thyristor (or TRIAC), a single-chip microcomputer, or a transistor, coupled or connected to the power line, generally referred to as a dimmer circuit. And the controllable electronic element may be configured to adjust a chosen signal feature of the input power Pin in response to the dimming signal Sdim, in order to transform the received input power Pin into the input power Pin_C resulting from the adjusting. In some cases, such as where the dimmer 50 is set to NOT cause dimming of the light, the dimmer-adjusted input power Pin_C may be the same as the input power Pin.

When the LED lighting apparatus 100 receives the input power Pin_C, the power supply module PM then transforms the received input power Pin_C into a stable driving power Sdry for the LED module LM to use, wherein the power supply module PM may generate the signal of driving power Sdry in the form of voltage (referred to as driving voltage) and/or current (referred to as driving current) corresponding to or based on the signal feature of the received input power Pin_C. Upon the driving power Sdry being generated, the LED module LM is configured to light up or emit light in response to the driving power Sdrv. The luminance or brightness of the LED module LM is related to the magnitude of the driving voltage and/or driving current of the driving power Sdrv, which is/are adjusted based on the signal feature of the received input power Pin_C, and the signal feature of the received input power Pin_C is controlled by the dimming signal Sdim. Therefore, the dimming signal Sdim is directly related to the luminance or brightness of the LED module LM. The signal processing involved in the operation of the power supply module PM for converting the received input power Pin_C into the driving power Sdry includes, but is not limited to, electrical rectification, electrical filtering, and DC-to-DC conversion. Some description is presented below of some embodiments of performing these steps for generating the driving power Sdrv.

Figure 1B:
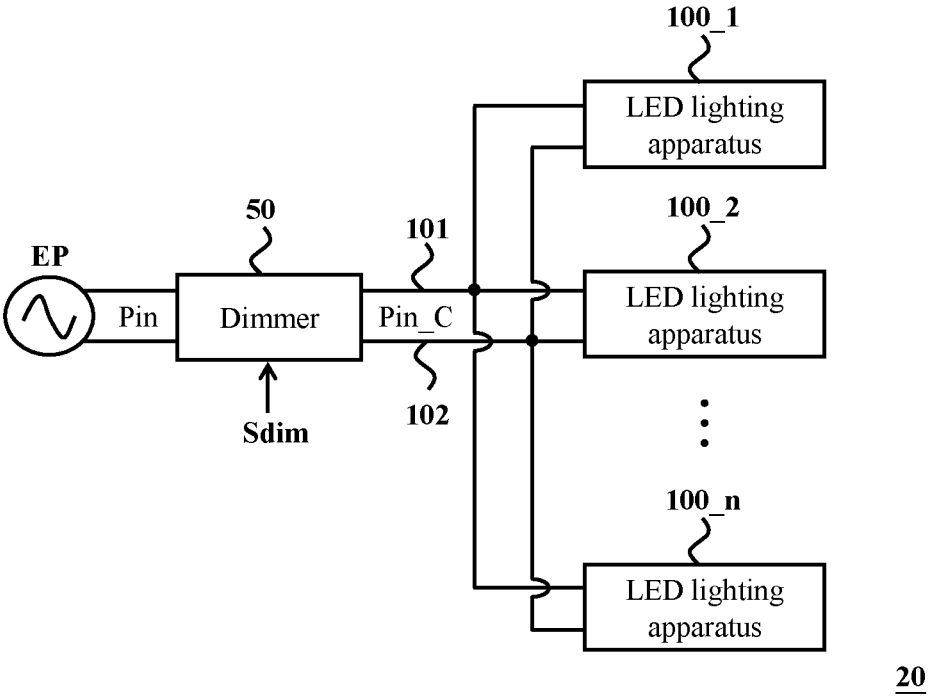
FIG. 1B is a block diagram of an LED lighting system according to another embodiment of the disclosure.

FIG. 1B is a block diagram of an LED lighting system according to another embodiment of the disclosure, showing the LED lighting system 20 in this embodiment includes a plurality of LED lighting apparatuses for operation with a dimmer. Referring to FIG. 1B, the LED lighting system 20 includes a dimmer 50 and a plurality of LED lighting apparatuses **100_1-100_*n*, wherein the symbol n is a positive integer larger than or equal to 2. In the LED lighting system 20, configuration(s) and function(s) of the dimmer 50 and each of the plurality of LED lighting apparatuses 100_1-100_*n* can be, and are assumed to be, the same as those of the dimmer 50 and the LED lighting apparatus 100 in the embodiment of FIG. 1A. A main difference between the embodiments of FIG. 1A and FIG. 1B is that the LED lighting apparatuses 100_1-100_*n* in the embodiment of FIG. 1B are arranged or connected in parallel with each other, i.e., first connection terminals 101 respectively of the LED lighting apparatuses 100_1-100_*n* are electrically connected together, and second connection terminals 102 respectively of the LED lighting apparatuses 100_1-100_*n*** are electrically connected together.

Under the configurations of the embodiment of FIG. 1B, the input power Pin_C in FIG. 1B may be concurrently provided to every one of the LED lighting apparatuses **100_1-100_*n*, which are then concurrently caused to light up. So, in some embodiments, when a dimming signal Sdim in FIG. 1B is applied or adjusted, the luminance respectively of the LED lighting apparatuses 100_1-100_*n* are then concurrently caused to change. Since the dimming control of the LED lighting system 20 of FIG. 1B can be implemented by adjusting or modulating a signal feature of the input power Pin, a separate signal line connected to each of the LED lighting apparatuses 100_1-100_*n* and for receiving a dimming signal is not needed, thus greatly simplifying the layout of electrical wiring(s) between included elements and reducing complexity of installations thereof for control of a plurality of LED lighting apparatuses in the application environment of the LED lighting system 20**.

Figure 2:
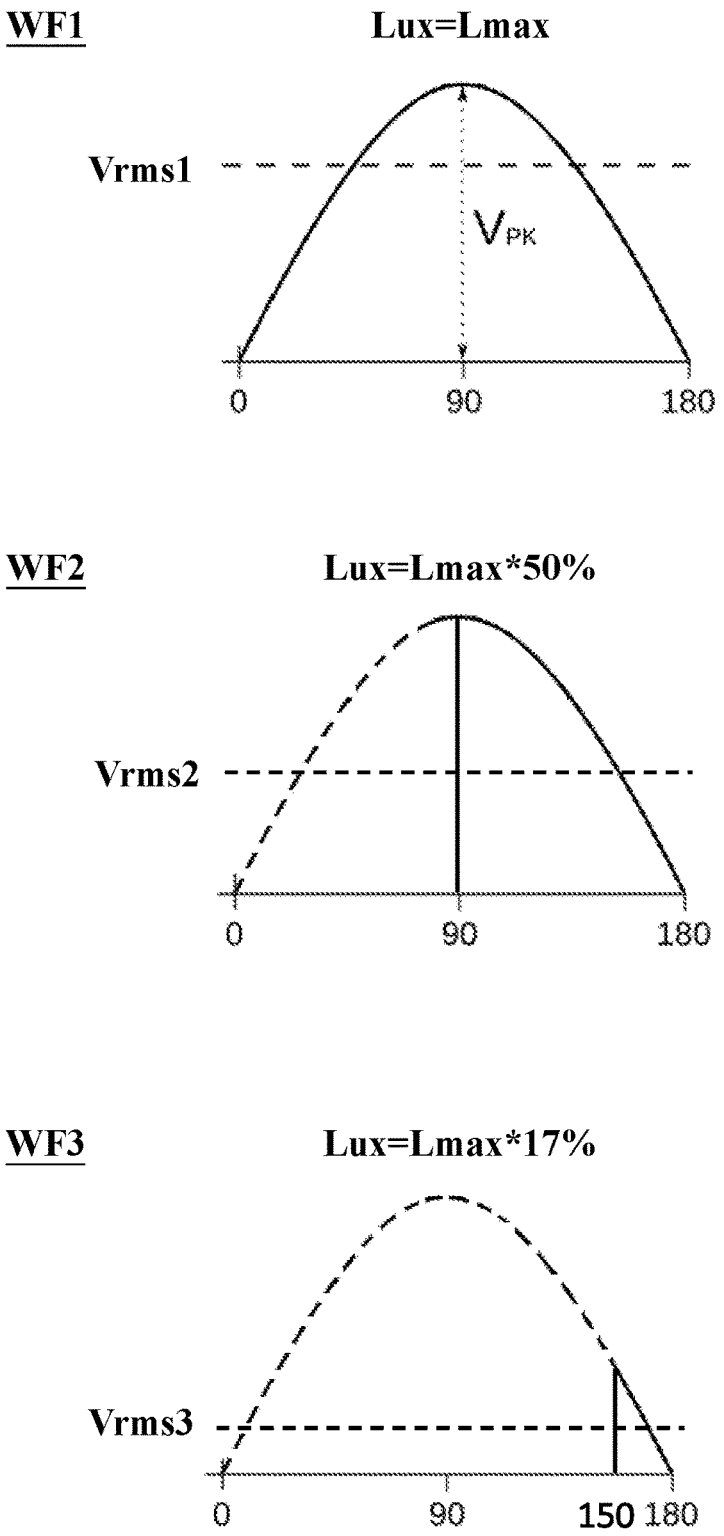
FIG. 2 is a signal waveform diagram of signal waveforms illustrating dimming or adjusting of brightness/luminance in a lighting system of an LED lighting apparatus.

Specifically, there are various applicable ways to implement dimming control by adjusting a signal feature of the input power Pin. A common way is to vary or adjust the effective or RMS (root-mean-square) value of the input power signal Pin by adjusting the phase conduction angle of the input power signal Pin, in order to adjust the magnitude of the driving power Sdrv. A description follows of a method of dimming control and corresponding circuit operations in such a common way with reference to FIGS. 1A and 2, wherein FIG. 2 is a signal waveform diagram of signal waveforms illustrating dimming or adjusting of brightness/luminance in a lighting system of an LED lighting apparatus. Referring to FIGS. 1A and 2, in the description of the present embodiment, the external power grid EP is assumed to provide AC power as the input power Pin for example, and the signal waveforms of FIG. 2 illustrate voltage waveforms for a (positive) half cycle of the input power Pin having an amplitude VPK for example. In FIG. 2, the signal waveforms from top to bottom are respectively voltage waveforms WF1, WF2, and WF3 corresponding to three different dimming control states or situations of the luminance Lux (of the LED lighting apparatus 100 of FIG. 1A) being at its maximum Lmax, being at 50% of its maximum Lmax, and being at 17% of its maximum Lmax, respectively. In these embodiments of FIG. 2, the dimmer 50 of FIG. 1A may be configured to adjust the phase-cut angle (or phase conduction angle) of the input power Pin by controlling the current conduction or cutoff state of the controllable electronic element electrically connected on the power line in series. For example, in order to modulate the input power Pin to have a phase-cut angle of 90 degrees, the dimmer of FIG. 1A may be configured to cut off the controllable electronic element at or within ¼ cycle of the input power signal Pin and then maintain or keep the controllable electronic element at the current conduction state for the rest of the half cycle of the input power signal Pin. In this way, for the half cycle of the input power signal Pin, the resulting voltage waveform has a value of zero for the phase angle of 0-90 degrees of the input power signal Pin and then has part of a sinusoidal waveform following that for the phase angle of 90-180 degrees of the input power signal Pin, but the invention is not limited to the forward phase-cut (i.e., the leading-edge dimming control). Accordingly, the input power signal Pin undergoes the cutting off of phase angle performed by the dimmer 50 to produce or result in the input power signal Pin_C with a phase conduction angle of 90 degrees. There are other embodiments of modulating the input power signal Pin to have a phase-cut angle that have principles similar to the described principle of this example.

Regarding the voltage waveform WF1 of FIG. 2 first, when the dimmer 50 in response to the dimming signal Sdim modulates the input power Pin to have a phase-cut angle of 0 degree, meaning the input power Pin has a phase conduction angle of 180 degrees, the dimmer 50 directly provides or reproduces the input power signal Pin to the LED lighting apparatus 100 of FIG. 1A, so the input power signal Pin_C is the same as or corresponds to the input power signal Pin. In this case, assuming the effective value of the input power signal Pin_C to be Vrms1, the power supply module PM of FIG. 1A then generates a corresponding driving power Sdrv, based on the input power signal Pin_C of the effective value Vrms1, in order to drive the LED module LM of FIG. 1A so that the luminance Lux of the LED module LM is at its maximum level Lmax.

Regarding the voltage waveform WF2 of FIG. 2, when the dimmer 50 in response to the dimming signal Sdim modulates the input power Pin to have a phase-cut angle of 90 degrees, meaning the input power Pin has a phase conduction angle of 90 degrees, the dimmer 50 cuts off the power line for the phase angle of 0-90 degrees of the input power signal Pin and then causes current conduction through the power line for the phase angle of 90-180 degrees of the input power signal Pin. In this case, the effective value of the input power signal Pin_C is smaller than the effective value Vrms1 and assumed to be Vrms2, and the input power signal Pin_C of the effective value Vrms2 causes the luminance Lux of the LED module LM to be at 50% of its maximum level Lmax.

Next regarding the voltage waveform WF3 of FIG. 2, when the dimmer 50 in response to the dimming signal Sdim modulates the input power Pin to have a phase-cut angle of 150 degrees, meaning the input power Pin has a phase conduction angle of 30 degrees, the dimmer 50 cuts off the power line for the phase angle of 0-150 degrees of the input power signal Pin and then causes current conduction through the power line for the phase angle of 150-180 degrees of the input power signal Pin. In this case, the effective value of the input power signal Pin_C is smaller than the effective value Vrms2 and assumed to be Vrms3, and the input power signal Pin_C of the effective value Vrms3 causes the luminance Lux of the LED module LM to be at 17% of its maximum level Lmax.

According to the dimming method described above with reference to FIGS. 1A and 2, by modulating the input power signal Pin to have a phase-cut angle or a phase conduction angle the dimmer 50 of FIG. 1A can cause corresponding variation in the effective value of the input power signal Pin_C, which may be varied to be, e.g., Vrms1, Vrms2, or Vrms3. In practice, the caused variation in the effective value of the input power signal Pin_C is typically in positive correlation with the variation in its phase conduction angle, that is, the larger the phase conduction angle of the input power signal Pin_C the larger its effective value. Accordingly, the caused variation in the effective value of the input power signal Pin_C is typically in negative correlation with the variation in its phase-cut angle. Thus, the described common way of dimming control realizes the function of dimming control by adjusting the effective value of the input power signal Pin. An advantage of this common way is that because the generated driving power Sdry varies directly corresponding to the variation in the effective value of the input power signal Pin_C, original hardware structures or parts of a regular LED lighting apparatus 100 need not be retrofitted or adapted for realizing dimming control, for which purpose mainly adding a dimmer 50 is needed in an LED lighting system.

More specifically, in the common way of implementing dimming control, in order to cause a sufficient variation in the effective value of the input power signal Pin_C for tuning the luminance/brightness of the LED module, the dimmer 50 must adjust or modulate the phase-cut angle (or the phase conduction angle) in a relative wide range to adjust the effective value of the input power signal Pin_C. The relative wide range of the phase-cut angle can refer to, for example, from 0 degree to 180 degrees as illustrated in FIG. 2. However, when the phase conduction angle of the input power signal Pin_C is small to a degree, the operating power supply module PM might be negatively impacted by significant effects of characteristics such as total harmonic distortion (THD) and power factor (PF) such that the power conversion efficiency of the power supply module PM is significantly small or reduced, which may even cause the problem of light-flickering of the LED module LM. So, under this common way of the dimming control, it's hard to improve the power conversion efficiency of the power supply module PM, due to such limitations of the dimmer 50.

In another aspect, since the effective value of the modulating input power signal Pin_C is directly affected by the magnitude of the amplitude VPK, a dimmer 50 using the described common way of realizing dimming control may not be compatible with various voltage specifications of standard power grids, such as AC voltage specifications of 120V, 230V, and 277V. Therefore a designer likely needs to adjust parameters or hardware designs according to the application environment of an LED lighting system 10, which will increase the overall production cost of products of the LED lighting system 10.

In response to the above problems, the present disclosure presents a new dimming control method, and an LED lighting system and an LED lighting apparatus using the same. Each of the LED lighting system and LED lighting apparatus is configured to receive a dimmer-adjusted signal (which can also be referred to as a modulated signal) produced by varying the phase-cut angle or phase conduction angle of the input power Pin, then to obtain an actual dimming message by demodulating the dimmer-adjusted signal, and then according to the obtained dimming message, to control circuit operation(s) of the power supply module PM to generate the driving power Sdrv. Since variation of the phase-cut angle or phase conduction angle is intended for merely carrying the dimming message corresponding to a dimming signal Sdim, but not for directly adjusting the effective value of the input power Pin_C, the dimmer 50 may vary the phase-cut angle or phase conduction angle of the input power Pin within a relatively small phase angle/range so as to cause a relatively small difference between effective values respectively of the dimmer-adjusted input power Pin_C and the input power Pin provided by the external power grid EP. By this way of dimming control, no matter under what luminance state, the phase conduction angle of the input power Pin will be similar to that of the modulating input power Pin_C, and therefore the characteristics of total harmonic distortion (THD) and power factor (PF) can be maintained/controlled, meaning the power conversion efficiency of the power supply module PM may not be inhibited or hindered by the dimmer 50. Further explanations of relevant structures and operations of the dimming control method and corresponding LED lighting apparatus/system taught by the disclosure are presented below.

Figure 3:
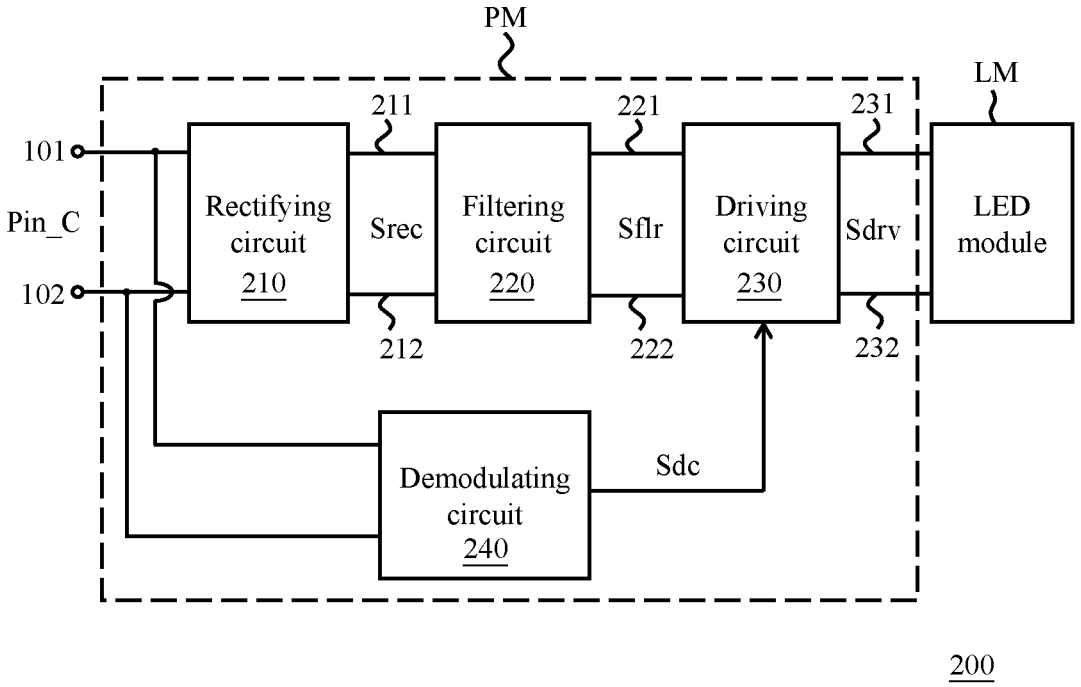
FIG. 3 is a circuit block diagram of an LED lighting apparatus according to an embodiment of the disclosure.

FIG. 3 is a circuit block diagram of an LED lighting apparatus according to an embodiment of the disclosure. Referring to FIG. 3, the LED lighting apparatus 200 may be applied in the LED lighting system 10 or 20 of FIGS. 1A and 1B. The LED lighting apparatus 200 includes a power supply module PM and an LED module LM, wherein the power supply module PM includes a rectifying circuit 210, a filtering circuit 220, a driving circuit 230, and a demodulating circuit 240. The LED lighting apparatus may be an LED lamp, or LED light bulb, for example.

The rectifying circuit 210 is configured to receive an input power Pin_C through first and second connection terminals 101 and 102, in order to rectify the input power Pin_C and then output a rectified signal Srec through first and second rectifying output terminals 211 and 212. The input power Pin_C may be or comprise an AC signal or DC signal, either type of signal can be compatible with designed operations of the LED lighting apparatus 200. The input power Pin_C may be, for example, the signal output from a dimmer circuit (e.g., a dimmer-adjusted input power signal). When the LED lighting apparatus 200 is designed to light based on an input DC signal, the rectifying circuit 210 in the power supply module PM may be omitted. When the rectifying circuit 210 is omitted, the first and second connection terminals 101 and 102 would be coupled directly to input terminal(s) of the filtering circuit 220, which would be the first and second rectifying output terminals 211 and 212 if the rectifying circuit 210 were present. In various embodiments, the rectifying circuit 210 may comprise a full-wave rectifying circuit, a half-wave rectifying circuit, a bridge-type rectifying circuit, or other type of rectifying circuit, and the disclosed invention is not limited to any of these types.

The filtering circuit 220 is electrically connected to the rectifying circuit 210, in order to electrically filter the rectified signal Srec, wherein input terminals of the filtering circuit 220 are coupled to the first and second rectifying output terminals 211 and 212 in order to receive and then electrically filter the rectified signal Srec. A resulting filtered signal Sflr is output at first and second filtering output terminals 221 and 222. It's noted that the first rectifying output terminal 211 may be regarded as the first filtering output terminal 221 and the second rectifying output terminal 212 may be regarded as the second filtering output terminal 222. In certain embodiments, the filtering circuit 220 can filter out ripples of the rectified signal Srec, causing the waveform of the filtered signal Sflr to be smoother than that of the rectified signal Srec. In addition, circuit configurations of the filtering circuit 220 may be designed so as to filter as to a specific frequency, for example, to filter out circuit response to a specific frequency of an input external driving signal. In some embodiments, the filtering circuit 220 is a circuit comprising at least one of a resistor, a capacitor, or an inductor, such as a parallel-connected capacitor filter or a pi-shape filter, but the invention is not limited to any of these types of filtering circuit. As is well known, a pi-shape filter looks like the symbol $\pi$ in its shape of circuit schematic.

The driving circuit 230 is electrically connected to the filtering circuit 220, in order to receive, and then perform power conversion on, the filtered signal Sflr, to produce a driving power signal Sdrv, wherein input terminals of the driving circuit 230 are coupled to the first and second filtering output terminals 221 and 222 in order to receive the filtered signal Sflr and then produce the driving power signal Sdry for driving the LED module LM to emit light. It's noted that the first filtering output terminal 221 may be regarded as a first driving output terminal 231 of the driving circuit 230 and/or the second filtering output terminal 222 may be regarded as a second driving output terminal 232 of the driving circuit 230. The driving power signal Sdry produced by the driving circuit 230 is then provided to the LED module LM through the first driving output terminal 231 and second driving output terminal 232, to cause the LED module LM to light up in response to the received driving power signal Sdrv. Further explanation of an embodiment of the driving circuit 230 is as follows with reference to FIG. 4.

Figure 4:
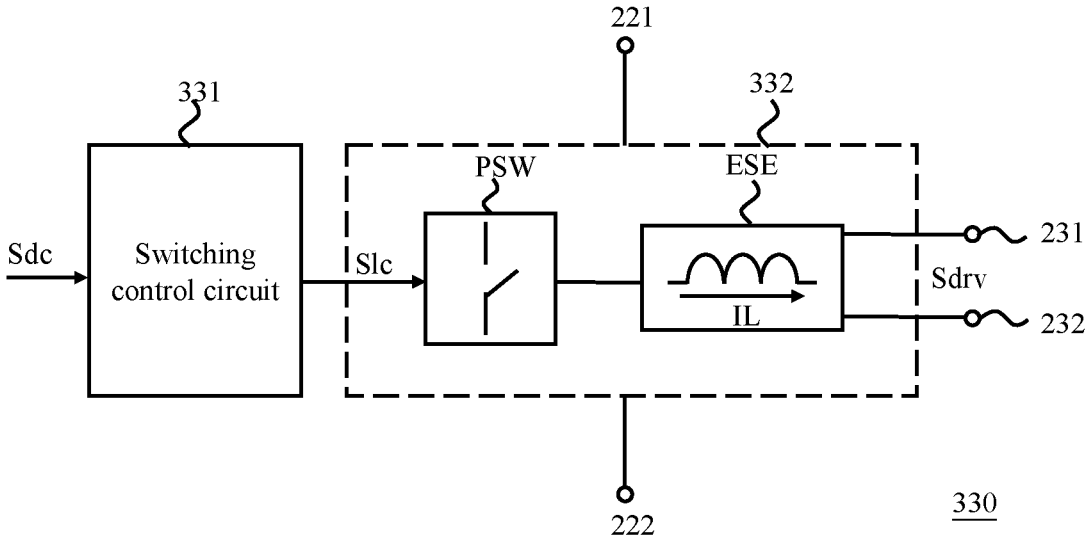
FIG. 4 is a circuit block diagram of a driving circuit according to an embodiment of the disclosure.

FIG. 4 is a circuit block diagram of a driving circuit according to an embodiment of the disclosure. With reference to both FIGS. 3 and 4, a driving circuit 330 of FIG. 4 is an embodiment of the driving circuit 230 of FIG. 3, and includes a switching control circuit 331 and a conversion circuit 332 for power conversion based on a current source, for driving the LED module LM to emit light. The conversion circuit 332 includes a switching circuit PSW (also known as a power switch) and an energy storage circuit ESE. The conversion circuit 332 is coupled to the first and second filtering output terminals 221 and 222 in order to receive and then convert the filtered signal Sflr, under the control by the switching control circuit 331, into a driving power signal Sdry output at the first and second driving output terminals 231 and 232 for driving the LED module LM. The conversion circuit may additionally include a diode (not shown). For example, a diode and switching circuit PSW may be connected in series between first and second filtering output terminals 221 and 222, with the energy storage circuit ESE connected at one end to a node between the diode and the switching circuit PSW and connected at an opposite end to one of the first or second driving output terminals 231 or 232. An end of one of the diode or the switching circuit PSW opposite the node may connect directly to one of the first or second filtering output terminals 221 or 222, while the other of the first or second driving output terminals 231 or 232 may be directly connected to the other of the first or second filtering output terminals 221 or 222. Under the control by the switching control circuit 331, the driving power output by the conversion circuit 332 comprises a steady current, making the LED module LM emit steady light. Further, the driving circuit 330 may include a bias circuit (not shown in FIG. 4), which may be configured to generate a working voltage Vcc based on a power line voltage of the power supply module PM and to be used by the switching control circuit 331, for the switching control circuit 331 to be activated and operate in response to the working voltage Vcc.

The switching control circuit 331 in this embodiment of FIG. 4 is configured to perform real-time regulation or adjusting of the duty cycle of a lighting control signal Slc according to current operational states of the LED module LM, in order to conduct or cut off the switching circuit PSW according to or in response to the lighting control signal Slc. The switching control circuit 331 can determine or judge a current operational state of the LED module LM by detecting one or more of an input voltage (such as a voltage level on the first connection terminal 101 or the second connection terminal 102, on the first rectifying output terminal 211, or on the first filtering output terminal 221), an output voltage (such as a voltage level on the first driving output terminal 231), an input current (such as a current on the input power line or flowing through the rectifying output terminal 211/212 and the filtering output terminal 221/222), and an output current (such as a current flowing through the driving output terminal 231/232 or energy storage circuit ESE or the switching circuit PSW). The energy storage circuit ESE is configured to alternate or switch its operation between being charged with energy and discharging energy, according to the state of the switching circuit PSW either conducting or being cut off, in order to maintain or make the driving power signal Sdry received by the LED module LM be stably above a predefined current value Ipred.

The demodulating circuit 240 of FIG. 3 has input terminals electrically connected to the first and second connection terminals 101 and 102 in order to receive an input power Pin_C, and has an output terminal electrically connected to the driving circuit 230 in order to provide a dimming control signal Sdc to the driving circuit 230. The demodulating circuit 240 is configured to generate the dimming control signal Sdc according to the magnitude of the phase-cut angle or conduction phase angle applied for each cycle or half-cycle of the input power signal Pin_C, wherein the switching control circuit 331 is configured to adjust its output of the lighting control signal Slc according to the dimming control signal Sdc so as to cause the driving power signal Sdry to vary in response to variation of the lighting control signal Slc. For example, the switching control circuit 331 is configured to adjust the duty cycle of the lighting control signal Slc according to the dimming control signal Sdc, so as to cause the driving power signal Sdry to increase or decrease in response to a luminance message indicated by the dimming control signal Sdc. When the dimming control signal Sdc indicates a higher luminance or color temperature, the switching control circuit 331 may increase the duty cycle of the lighting control signal Slc according to the dimming control signal Sdc, so as to cause the energy storage circuit ESE to output a higher driving power signal Sdry for the LED module LM. On the contrary, when the dimming control signal Sdc indicates a lower luminance or color temperature, the switching control circuit 331 may decrease the duty cycle of the lighting control signal Slc according to the dimming control signal Sdc, so as to cause the energy storage circuit ESE to output a lower driving power signal Sdry for the LED module LM. The duty cycle may refer, for example, to a percentage of time during a cycle (or half-cycle) for which the lighting control signal Slc has sufficient voltage to turn on switching circuit PSW. By these ways of adjusting, effects of dimming control can be achieved.

More specifically, the demodulation process performed by the demodulating circuit 240 may comprise a signal conversion method such as sampling, time counting, or mapping or functioning between signals. For example, for each cycle or half cycle of the input power signal Pin_C, the demodulating circuit 240 may count for a period of time, and sample the input power signal Pin_C within the period of time to obtain the time length for which the input power signal Pin_C remains at a zero voltage level. For example, the input power signal Pin_C may be output from a dimmer circuit that sets the input power signal Pin_C to zero volts for a particular portion of the input power signal cycle. Since the cycle of the input power signal Pin_C is fixed, the phase-cut angle can be obtained by calculating the ratio of the time length that the input power signal Pin_C remains at the zero voltage level to the time length of the cycle of the input power signal Pin_C. The time length that the input power signal Pin_C remains at the zero voltage level corresponds to the phase-cut angle directly. Therefore, the demodulating circuit 240 can convert the phase-cut angle into a dimming control signal Sdc capable of controlling the switching control circuit 331 by mapping the time length that the input power signal Pin_C remains at the zero voltage level, for example linearly or nonlinearly, into a voltage level. This dimming control signal Sdc may correspond to dimming signal Sdim, which serves as a dimming message to control the amount of dimming. The range of the voltage level after mapping may be selected according to the voltage rating of the switching control circuit 331, and is for example between 0V and 5V. Further description of signal waveforms and circuit operations in an LED lighting system including the LED lighting apparatus 200 under different dimming control states or situations is as follows with reference to FIGS. 5A and 5B, which is a signal waveform diagram of signal waveforms illustrating dimming or adjusting of luminance according to an embodiment of the disclosure.

Figure 5A:
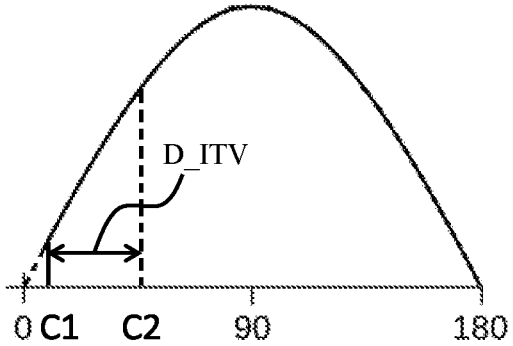
FIGS. 5A and 5B are signal waveform diagrams of signal waveforms illustrating dimming or adjusting of luminance according to certain embodiments of the disclosure.
Figure 5A:
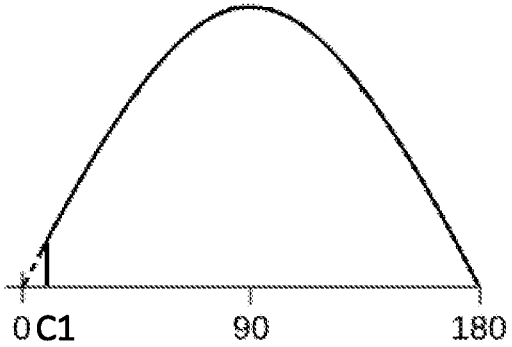
Figure 5A:
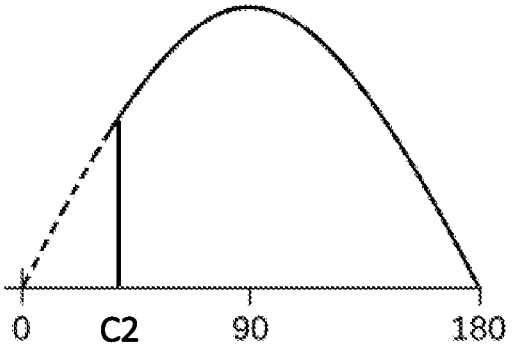

Referring to FIGS. 3 to 5A, in this embodiment, the dimmer 50 may for example vary the phase-cut angle of the input power signal Pin within a dimming phase range D_ITV. In FIG. 5A, the signal waveforms from top to bottom are respectively a voltage waveform WF4 showing the dimming phase range D_ITV, a voltage waveform WF5 corresponding to the dimming control state of the luminance Lux (of the LED lighting apparatus 200 of FIG. 3) being at its maximum Lmax, and a voltage waveform WF6 corresponding to the dimming control state of the luminance Lux being at its minimum Lmin.

With regard to the voltage waveform WF4 in the embodiment of FIG. 5A first, the dimming phase range D_ITV is the difference between a maximum phase-cut angle C2 and a minimum phase-cut angle C1, which minimum phase-cut angle C1 may be any number (such as 1, 2, or 3) of degrees in the range of between 0 and 15 degrees and which maximum phase-cut angle C2 may be any number (such as 21, 22, or 23) of degrees in the range of between 20 and 45 degrees, but the present invention is not limited to any of these ranges. So the dimming phase range D_ITV may be for example a phase difference between 0 and 45 degrees, between 5 and 45 degrees, between 5 and 20 degrees, between 15 and 20 degrees, or between 15 and 45 degrees, depending on the design needs. Note that these examples are for an amount of phase-cut angle within a half-cycle (i.e., 180 degrees), and may be described as a certain phase-cut ratio or percentage (e.g., where 45 degrees corresponds to a 25% phase cut of a cycle or half-cycle, etc.). Preferably the choice of the maximum phase-cut angle C2 is based on two factors or principles. The first factor is that the size of the dimming phase range D_ITV should afford distinguishable states of luminance after mapping performed by the demodulating circuit 240. And the second factor is that when the dimmer 50 produces the input power signal Pin_C having the maximum phase-cut angle C2, the characteristics of total harmonic distortion (THD) and power factor (PF) of the power supply module PM of FIG. 3 can still be maintained/controlled, for example having values of the THD and PF no smaller than 80% of values of the THD and PF when the dimmer 50 produces the input power signal Pin_C having the minimum phase-cut angle C1, or preferably the value of the THD is larger than 25 and the value of the PF is larger than 0.9.

With regard to the voltage waveform WF5 of FIG. 5A, when the dimmer 50 in response to the dimming signal Sdim modulates the input power Pin to result in the minimum phase-cut angle C1, meaning the input power signal Pin_C has a conduction phase angle of (180-C1) degrees, the dimmer 50 cuts off the power line for the phase angle of 0-C1 degrees of the input power signal Pin and then causes current conduction through the power line for the phase angle of C1-180 degrees of the input power signal Pin. In this case, the demodulating circuit 240 generates a dimming control signal Sdc indicative of adjusting the luminance Lux to its maximum Lmax, according to the input power signal Pin_C having the minimum phase-cut angle C1. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the maximum Lmax.

Next, with regard to the voltage waveform WF6 of FIG. 5, when the dimmer 50 in response to the dimming signal Sdim modulates the input power Pin to result in the maximum phase-cut angle C2, meaning the input power Pin_C2 has a conduction phase angle of (180-C2) degrees, the dimmer 50 cuts off the power line for the phase angle of 0-C2 degrees of the input power signal Pin and then causes current conduction through the power line for the phase angle of C2-180 degrees of the input power signal Pin. In this case, the demodulating circuit 240 generates a dimming control signal Sdc indicative of adjusting the luminance Lux into its minimum Lmin, according to the input power signal Pin_C having the maximum phase-cut angle C2. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the minimum Lmin. In this embodiment, the minimum luminance Lmin is for example about 10% of the maximum luminance Lmax.

In comparison to the described dimming control method illustrated by FIG. 2, although the phase-cut angle or phase conduction angle is applied for dimming control, variation of the phase-cut angle or conduction phase angle of the resulting input power signal Pin_C in this embodiment of FIG. 5A is merely used as a reference signal indicative of a dimming message, rather than reflecting the effective value of the input power signal Pin_C in the luminance of the lighting LED module LM. So under the dimming control method of this embodiment of FIG. 5A the chosen dimming phase range D_ITV would be apparently smaller than that under the dimming control method of the embodiment of FIG. 2. From another perspective, under the dimming control method of this embodiment of FIG. 5A, no matter whether the dimmer 50 modulates the input power signal Pin by any particular phase-cut angle within the dimming phase range D_ITV, the effective value of the resulting input power signal Pin_C will not be much different. For example, in some embodiments, the effective value of the resulting input power signal Pin_C having the maximum phase-cut angle C2, such as the effective value of the voltage waveform WF6 of FIG. 5A, is not lower than 50% of the effective value of the resulting input power signal Pin_C having the minimum phase-cut angle C1, such as the effective value of the voltage waveform WF5 of FIG. 5.

From another perspective, in the ordinary dimming control method described in FIG. 2, since the luminance of the LED module lighting based on the received modulated input power signal Pin_C is directly correlated with the effective value of the modulated input power signal Pin_C, the scope ratio of the effective value of the modulated input power signal Pin_C is substantially or roughly the same as the scope ratio of the luminance of the lighting LED module, wherein the scope ratio of the effective value of the modulated input power signal Pin_C refers to the ratio of the maximum value to the minimum value of the effective value (e.g., RMS value) of the modulated input power signal Pin_C, and the scope ratio of the luminance of the lighting LED module refers to the ratio of the maximum value to the minimum value of the luminance. On the contrary, according to the embodiments described of FIG. 5A, the scope ratio of the effective value of the modulated input power signal Pin_C is not correlated with the scope ratio of the luminance of the lighting LED module. In some preferable embodiments, the scope ratio of the effective value of the modulated input power signal Pin_C is smaller than the scope ratio of the luminance of the lighting LED module. And in some preferable embodiments, the scope ratio of the effective value of the modulated input power signal Pin_C is smaller than or equal to 2 (e.g., ratio of RMS value at the maximum modulated input power to RMS value at the minimum modulated input power), and the scope ratio of the luminance of the lighting LED module is larger than or equal to 10 (e.g., ratio of luminance when the maximum modulated input power is supplied to the luminance when the minimum modulated input power is supplied). The scope ratio of the luminance of the lighting LED module may therefore be more than twice the scope ratio of the effective value of the modulated input power signal Pin_C, and in some cases more than 5 times the scope ratio of the effective value of the modulated input power signal Pin_C.

It should be noted that the described positive correlation of the luminance Lux of the LED module LM with respect to the variation of the phase-cut angle is only exemplary but is not limiting, and in other embodiments the luminance Lux of the LED module LM may be in negative correlation with the cut-off phase angle of the modulated input power signal Pin_C.

Figure 5B:
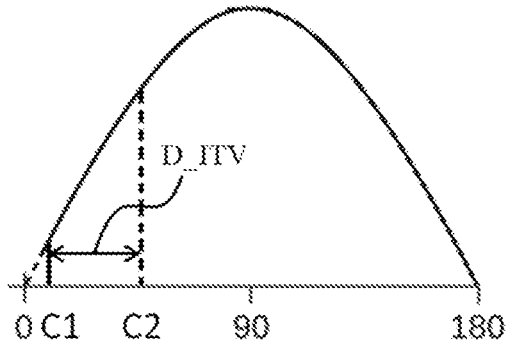
Figure 5B:
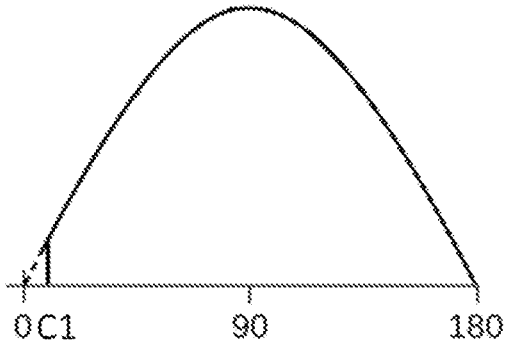
Figure 5B:
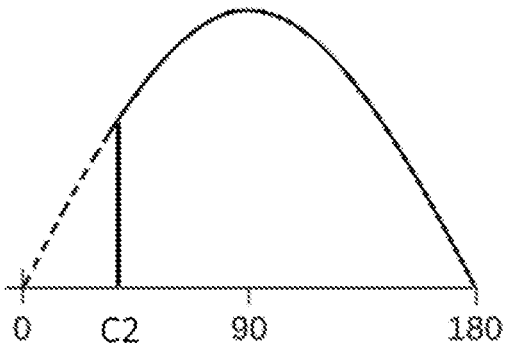

Referring to FIG. 5B, for example, respecting the voltage waveform WF7 in this embodiment, when the dimmer 50 in response to a dimming signal Sdim modulates the input power Pin to result in the minimum cut-off phase angle C1, meaning the input power Pin has a conduction phase angle of (180-C1) degrees, the dimmer 50 cuts off the power line for the phase angle of 0-C1 degrees of the input power signal Pin and then causes current conduction through the power line for the phase angle of C1-180 degrees of the input power signal Pin. In this case, the demodulating circuit 240 generates a dimming control signal Sdc indicative of adjusting the luminance Lux into its minimum Lmin, according to the modulated input power signal Pin_C having the cut-off phase angle C1. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the minimum luminance Lmin.

Next referring the voltage waveform WF8 of FIG. 5B, when the dimmer 50 in response to a dimming signal Sdim modulates the input power Pin to result in the cut-off phase angle C2, meaning the input power Pin has a conduction phase angle of (180-C2) degrees, the dimmer 50 cuts off the power line for the phase angle of 0 to C2 degrees of the input power signal Pin and then causes current conduction through the power line for the phase angle of C2 degrees to 180 degrees of the input power signal Pin. In this case, the demodulating circuit 240 generates a dimming control signal Sdc indicative of adjusting the luminance Lux into its maximum Lmax, according to the modulated input power signal Pin_C having the cut-off phase angle C2. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the maximum Lmax. It is noted that in the embodiments of both FIGS. 5A and 5B, the cut-off phase angle C2 is larger than the cut-off phase angle C1.

From one perspective, in the embodiment of FIG. 5A, the luminance Lux of the LED module LM is in negative correlation with the cut-off phase angle of the modulated input power Pin_C, and in the embodiment of FIG. 5B the luminance Lux of the LED module LM is in positive correlation with the cut-off phase angle of the modulated input power Pin_C. From another perspective, in the embodiment of FIG. 5A the luminance Lux of the LED module LM is in positive correlation with the effective value of the modulated input power Pin_C, and in the embodiment of FIG. 5B the luminance Lux of the LED module LM is in negative correlation with the effective value of the modulated input power Pin_C. In contrast, in the above described common way of varying or adjusting the effective value of the input power signal Pin the luminance Lux of the LED module LM can only be in positive correlation with the effective value of the modulated input power Pin_C. But with the present invention of this disclosure, the type of correlation between the luminance Lux of the LED module LM and the effective value or the phase-cut angle of the modulated input power Pin_C may be selected preferably according to actual or practical needs. Therefore, according to this disclosure, for example, it may be that the luminance Lux of the LED module LM is not directly proportional to the effective value of the modulated input power Pin_C.

Figure 6:
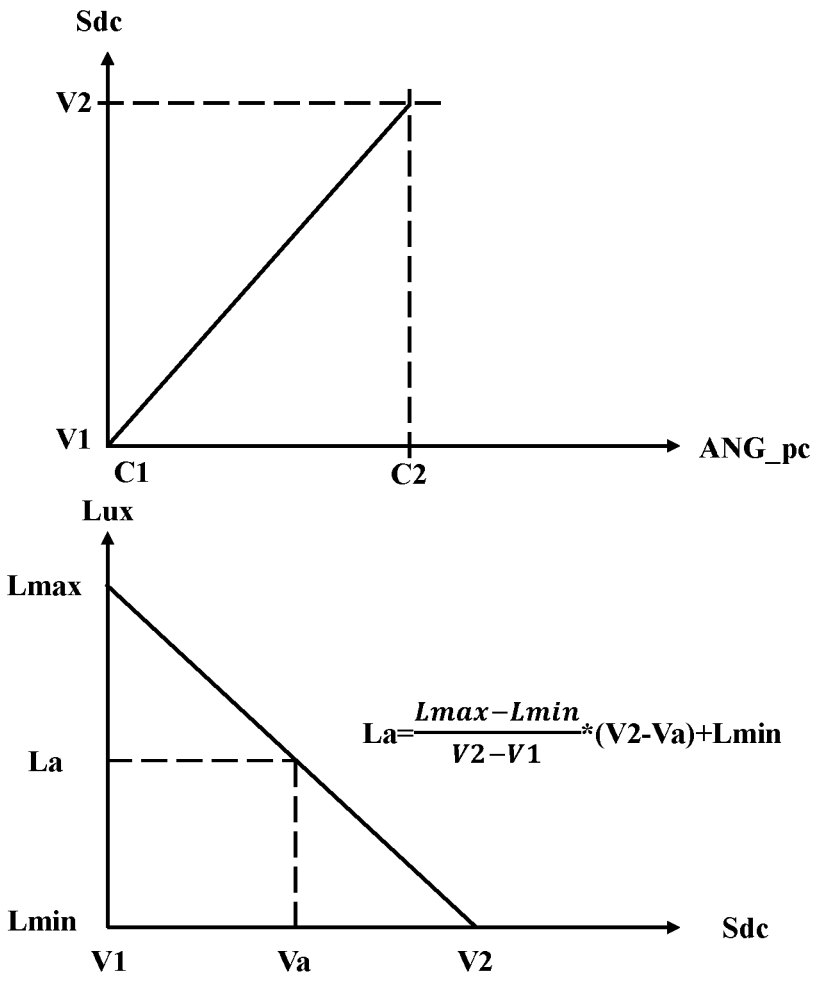
FIG. 6 illustrates a corresponding relationship between the three variables of a phase-cut angle for dimming, a demodulating signal, and the luminance of an LED module, according to an embodiment of the disclosure.
Figure 7:
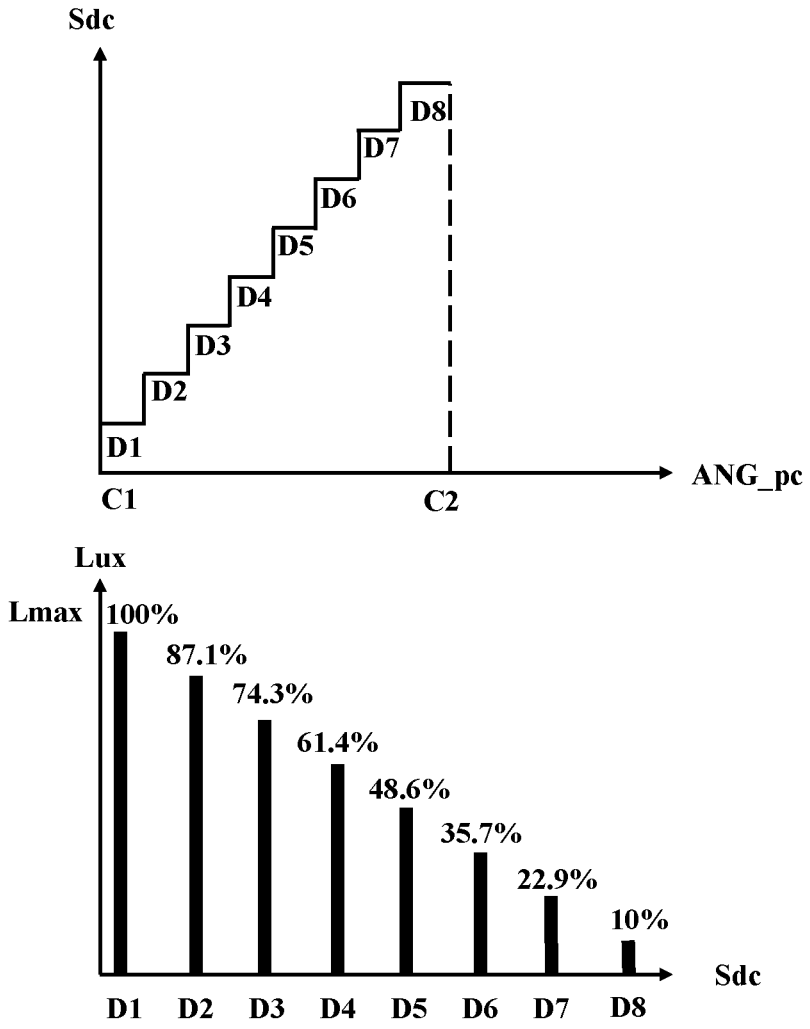
FIG. 7 illustrates a corresponding relationship between the three variables of a phase-cut angle for dimming, a demodulating signal, and the luminance of an LED module, according to another embodiment of the disclosure.

Next is a further description of circuit operations and mechanisms of signal generation in different embodiments of the demodulating circuit 240 illustrated by FIGS. 6 and 7. FIG. 6 illustrates a corresponding relationship between the three variables of a phase-cut angle for dimming, a demodulating signal, and the luminance of an LED module, according to an embodiment of the disclosure, and FIG. 7 illustrates a corresponding relationship between the three variables of a phase-cut angle for dimming, a demodulating signal, and the luminance of an LED module, according to another embodiment of the disclosure.

Referring to FIGS. 3, 4, and 6, the demodulating circuit 240 of this embodiment of FIG. 6 is configured to obtain and transform a dimming message by performing a signal processing method similar to analog signal processing. It can be seen from FIG. 6 that when the phase-cut angle ANG_pc of the dimmer-adjusted input power signal Pin_C is varied within the range of between the minimum phase-cut angle C1 and the maximum phase-cut angle C2, the voltage level of the dimming control signal Sdc is correspondingly varied within the range of between voltages V1 and V2. So the phase-cut angle ANG_pc of the dimmer-adjusted input power signal Pin_C varied within the dimming range of phase-cut angle is in linear positive correlation with the voltage level of the dimming control signal Sdc. From the perspective of operation of the demodulating circuit 240, when judging that the dimmer-adjusted input power signal Pin_C has the minimum phase-cut angle C1, the demodulating circuit 240 correspondingly converts the dimmer-adjusted input power signal Pin_C to generate a dimming control signal Sdc of the voltage level V1; and similarly, when judging that the dimmer-adjusted input power signal Pin_C has the maximum phase-cut angle C2, the demodulating circuit 240 correspondingly converts the dimmer-adjusted input power signal Pin_C to generate a dimming control signal Sdc of the voltage level V2. Different voltage levels between V1 and V2 can be generated as well based on a conversion performed by demodulating circuit 240 for phase-cut angles between C1 and C2. The different voltage levels V1 and V2 and those therebetween are used to respectively select different lighting control signals Slc. A linear conversion may be carried out using circuitry configured to convert particular phase-cut angles to particular voltage levels (e.g., using a look-up table or other circuitry). As a result, the demodulating circuit 240 may demodulate a modulated, phase-cut, dimmer-adjusted input power signal Pin_C to generate a demodulated signal, such as a constant voltage signal. The demodulating circuit 240 may also be described as a conversion circuit (different from conversion circuit 332), which converts a modulated input signal to an output signal, where the output signal is determined based on the modulated input signal.

Next, the dimming control signal Sdc in linear positive correlation with the phase-cut angle ANG_pc of the dimmer-adjusted input power signal Pin_C is provided to the switching control circuit 331 to cause the conversion circuit 332 to generate a corresponding driving power signal Sdry for driving the LED module LM and causing it to have a corresponding luminance Lux. In some embodiments, the luminance Lux of the LED module LM is in linear negative correlation with the voltage level of the dimming control signal Sdc. As shown in FIG. 6, when the dimming control signal Sdc received by the switching control circuit 331 has a voltage level Va in the range of between the voltage levels V1 and V2, the switching control circuit 331 adjusts the lighting control signal Slc accordingly to cause the LED module LM to light with a luminance La when being driven by the driving power signal Sdrv. In an embodiment, the luminance La is inversely proportional to the voltage level Va of the dimming control signal Sdc, and can be expressed by, but is not limited to, $$La = \frac{Lmax - Lmin}{V2 - V1} * (V2 - Va) + Lmin.$$

It should be noted that the above described mechanism of generating a dimming control signal Sdc in order to reach a luminance Lux of the lighting LED module LM is only an embodiment to illustrate a signal conversion method, similar to analog signal processing, of how the demodulating circuit 240 obtains or extracts a signal feature, such as the phase-cut angle, of the dimmer-adjusted input power signal Pin_C and then transforms/maps the signal feature into a dimming control signal Sdc for enabling the driving circuit 230 to adjust the luminance Lux of the LED module LM according to the dimming control signal Sdc. But the above described mechanism is not intended to limit the scope of the disclosed invention herein. In some embodiments, the relationship between the dimming control signal Sdc and the phase-cut angle ANG_pc may be a non-linear relationship, such as an exponential relationship. Similarly, the relationship between the dimming control signal Sdc and the luminance Lux may be a non-linear relationship. Although the disclosed invention herein is not limited to any of the described relationship herein. In some embodiments, the relationship between the phase-cut angle ANG_pc and the voltage level of the dimming control signal Sdc may be a negative correlation. And In some embodiments, the relationship between the luminance La and the voltage level Va may be a positive correlation.

Referring to FIGS. 3, 4, and 7, the demodulating circuit 240 of this embodiment of FIG. 7 is configured to obtain and transform a dimming message by performing a signal processing method similar to digital signal processing. Specifically, when the phase-cut angle of the modulated input power signal Pin_C is adjusted/varied in a dimming phase range (which also can be referred to as a default phase range), the dimming control signal may have a default number of different signal states corresponding to variations or values of the phase-cut angle, in order to control dimming of the LED module to the default number of different dimming levels respectively. It can be seen from FIG. 7 that when the phase-cut angle ANG_pc of the dimmer-adjusted input power signal Pin_C is varied within the range of between the minimum phase-cut angle C1 and the maximum phase-cut angle C2, the dimming control signal Sdc can have 8 different signal states D1-D8 according to variation of the phase-cut angle ANG_pc. So the dimming range of between the minimum phase-cut angle C1 and the maximum phase-cut angle C2 may be divided into 8 sub-ranges among which the phase-cut angle ANG_pc can be varied and corresponding to the 8 different signal states D1-D8 of the dimming control signal Sdc respectively. In some embodiments, the different signal states of the dimming control signal Sdc may be indicated or represented by different voltage levels, wherein for example the signal state D1 of the dimming control signal Sdc corresponds to a voltage level of 1V and the signal state D8 corresponds to a voltage level of 5V. In some embodiments, the different signal states of the dimming control signal Sdc may be indicated or represented by logical voltage levels coded in multiple bits, wherein for example the signal state D1 of the dimming control signal Sdc corresponds to a logical voltage level coded as the three-bit "000" and the signal state D8 corresponds to a logical voltage level coded as the three-bit "111". The dimming control signal Sdc may be used to control a pulse-width modulation, for example, of the lighting control signal Slc that controls the switching circuit PSW.

Next, the dimming control signal Sdc in the range of the 8 different signal states D1-D8 is provided to the switching control circuit 331 to cause the conversion circuit 332 to generate a corresponding driving power signal Sdry for driving the LED module LM and causing it to have a corresponding luminance Lux. In some embodiments, different values of the luminance Lux of the LED module LM are in one-to-one correspondence with the 8 different signal states D1-D8. As shown in FIG. 7, in this embodiment the 8 different signal states D1-D8 correspond to 100%, 87.5%, 75%, 62.5%, 50%, 37.5%, 25%, and 10% of the maximum value Lmax of the luminance Lux respectively. It's noted that the described embodiment of logical voltage level representation uses three bits to code the distinguishability of the 8 different signal states D1-D8 of the dimming control signal Sdc produced by the demodulating circuit 240, which is also known as an 8-section dimming, but the present invention disclosed herein is not limited to this number of bits. The dimming control signal Sdc may control the lighting control signal Slc, which in turn causes the conversion circuit 332 to generate a corresponding driving power signal Sdrv.

Figure 8:
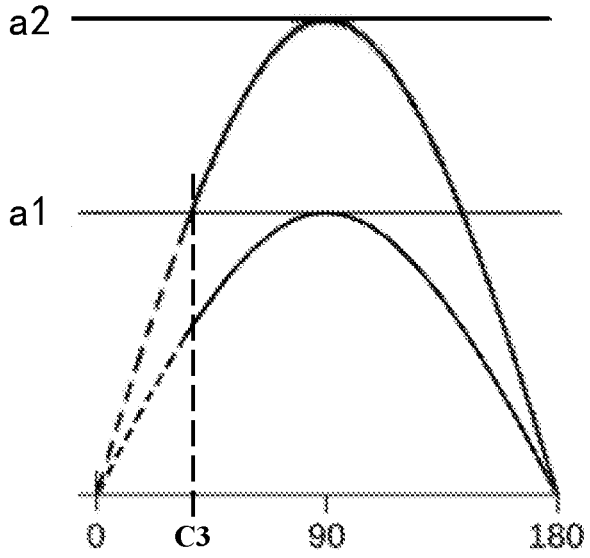
FIG. 8 is a signal waveform diagram of signal waveforms of input power signal of an LED lighting apparatus under different power grid voltages according to an embodiment of the disclosure.

FIG. 8 is a signal waveform diagram of signal waveforms of input power signal of an LED lighting apparatus under different power grid voltages according to an embodiment of the disclosure. Referring to the FIGS. 1A, 3, and 8, it can be seen that no matter whether the peak voltage or amplitude of the input power Pin is a1 or a2, if the dimmer 50 modulates the input power Pin to result in a phase-cut angle C3, the phase angle/interval of the zero voltage level in the dimmer-adjusted input power Pin_C (i.e. the phase angle between 0 degree and C3) generated by the dimmer 50 is the same. Therefore, no matter what the peak voltage or amplitude of the input power Pin is, the demodulating circuit 240 can demodulate any dimmer-adjusted input power Pin_C of the same phase-cut angle to produce the same dimming control signal Sdc. Therefore, no matter what the voltage amplitude of the external power grid EP supplying the LED lighting system 10 is, upon receiving the same dimming signal Sdim, the LED lighting system 10 can cause the LED lighting apparatus 100 to light with the same luminance or color temperature, and thus the LED lighting system 10 is compatible with various applications with different types of external power grid EP. In this manner, the dimming level of the LED module is not substantially affected by changes in the peak voltage of the input power signal or by an effective value of the input power signal. Also, the dimming level of the LED module is not directly proportional to an effective value of the input power signal.

From another perspective, in this disclosure, dimming of an LED module (with respect to e.g. its luminance or color temperature) is performed or achieved in response to the cut-off phase angle of the modulated input power signal Pin_C, but largely not in response to the peak voltage or amplitude of the external power grid (as EP).

In contrast, if adopting the described way of dimming control illustrated by FIG. 2, since the effective value of the dimmer-adjusted input power Pin_C even of the same phase-cut angle significantly varies according to different voltage amplitudes of types of applied input power, the described way of dimming control illustrated by FIG. 2 can only be customized or designed specifically for the actual application environment of an LED lighting system 10, which resulting design is not compatible with different types of applied input power.

It should be noted that in practice non-ideal conditions or situations often exist due to intrinsic parasitic effects and mismatches between electronic components. Therefore, although it's intended/desirable that dimming of the LED module is performed not in response to the peak voltage or amplitude of the external power grid, in practice the effects of dimming in embodiments of the present invention may still be somewhat in response to the peak voltage or amplitude of the external power grid. So, according to this disclosure, it may be acceptable that dimming of the LED module is somewhat in response to the peak voltage or amplitude of the external power grid due to such non-ideal conditions or situations. These allowable practical effects and response to the peak voltage or amplitude of the external power grid are referred to herein as being "largely" or "substantially" not in response to the peak voltage or amplitude of the external power grid or are referred to by describing power signals or voltage levels as being "substantially or roughly the same". And the above mentions of "somewhat" in one embodiment may each refer to the low degree of response that dimming of the LED module is impacted or affected, for example, by only less than 5% even when the peak voltage or amplitude of the external power grid is doubled.

Figure 9:
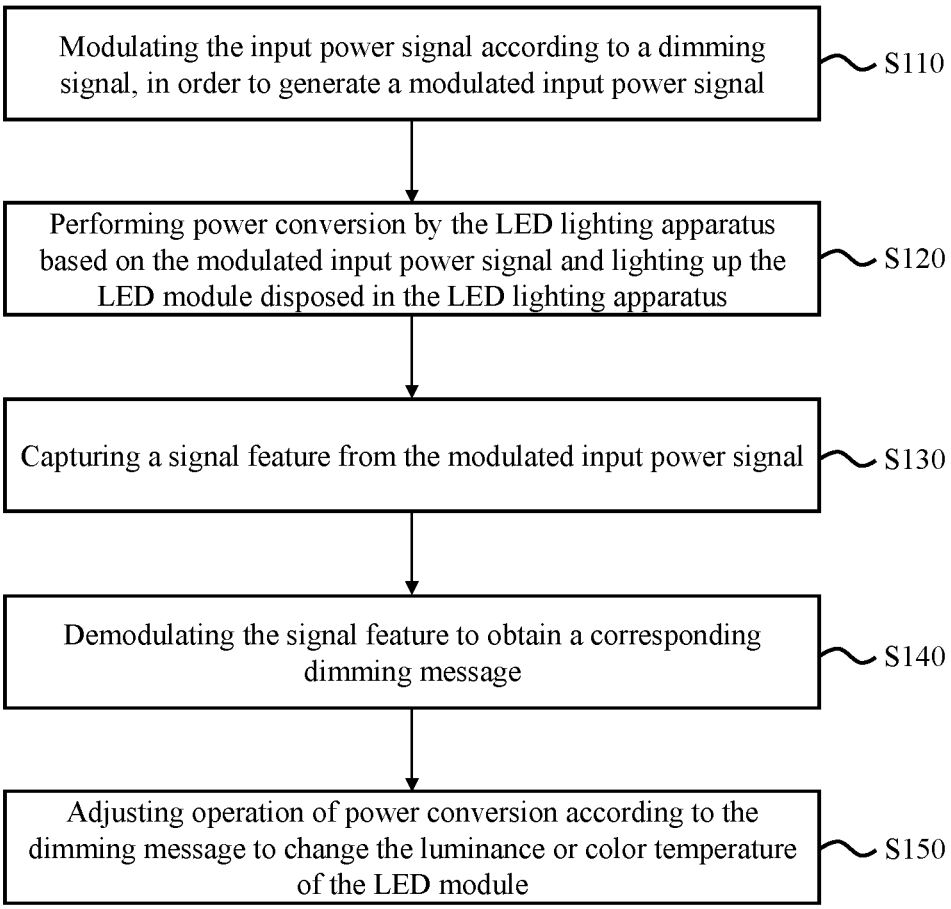
FIG. 9 is a flow chart of steps of a dimming control method for an LED lighting system according to an embodiment of the disclosure.

FIG. 9 is a flow chart of steps of a dimming control method for an LED lighting system according to an embodiment of the disclosure. Referring to both FIGS. 1A and 9, a whole dimming control method is described here from the perspective of the LED lighting system 10. First, the dimmer 50 modulates the input power Pin according to a dimming signal Sdim, in order to generate a dimmer-adjusted input power signal Pin_C (step S110), wherein the dimmer-adjusted input power signal Pin_C carries a signal feature indicative of a dimming message, which the signal feature is for example a phase-cut angle or phase conduction angle of the dimmer-adjusted input power signal Pin_C. The dimmer-adjusted input power signal Pin_C is then provided to the LED lighting apparatus 100, causing the LED lighting apparatus 100 to perform power conversion and light up the internal LED module according to the received input power Pin_C (step S120). On the other hand, the LED lighting apparatus 100 captures or extracts a signal feature of the received input power Pin_C (step S130), and then demodulates the signal feature to obtain a corresponding dimming message (step S140). And then the LED lighting apparatus 100 adjusts operation of power conversion according to the demodulated dimming message, in order to change/adjust the luminance or color temperature of the LED module (step S150).

Referring to FIGS. 3 and 9, the step of obtaining a signal feature of the received input power Pin_C (step S130), and the step of demodulating the received input power Pin_C (step S140) may be performed or achieved by a demodulating circuit 240 in the LED lighting apparatus 100/200. And the step of causing the LED lighting apparatus 100 to perform power conversion and light up the internal LED module according to the received input power Pin_C (step S120), and the step of adjusting operation of power conversion according to the demodulated dimming message in order to adjust the luminance of the LED module (step S150) may be performed or achieved by a driving circuit 230 in the LED lighting apparatus 100/200. As a result, when only a small range of phase-cut angles are used to create the dimmer-adjusted input power signal Pin_C, the luminance of the LED module may be affected in small part based on a direct power conversion, but may be affected in large part, and primarily, based on the control according to the output of the demodulating circuit 240, which, for example, can instruct the driving circuit 230 to perform additional dimming.

Figure 10:
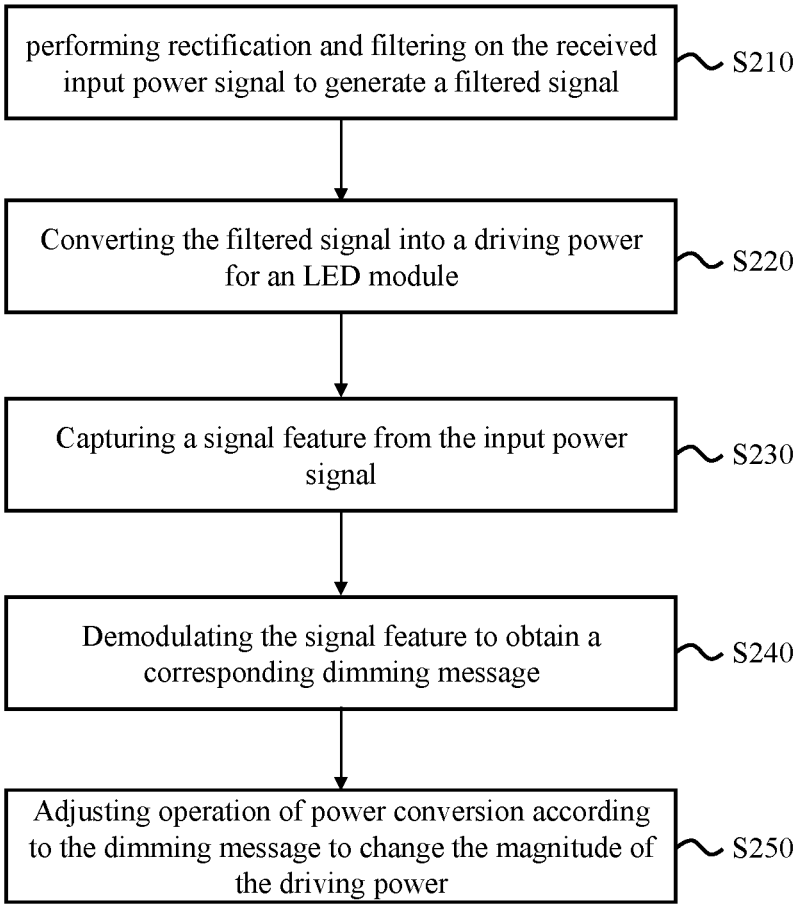
FIG. 10 is a flow chart of steps of a dimming control method for an LED lighting apparatus according to an embodiment of the disclosure.

Next a further description of a whole dimming control method from the perspective of the LED lighting apparatus 100 is presented with reference to FIG. 10. FIG. 10 is a flow chart of steps of a dimming control method for an LED lighting apparatus according to an embodiment of the disclosure. Referring to FIGS. 1A, 3, and 10, when the LED lighting apparatus 100 receives an input power Pin_C, a rectifying circuit 210 and a filtering circuit 220 perform a rectification and a filtering on the received input power Pin_C respectively in order to generate a filtered signal Sflr for a driving circuit 230 (step S210). The driving circuit 230 then performs power conversion on the received filtered signal Sflr and then generates a driving power signal Sdry for a later-stage LED module (step S220). On the other hand, a demodulating circuit 240 captures or extracts a signal feature of the received input power Pin_C (step S230), and then demodulates the signal feature to obtain a dimming message and generate a corresponding dimming control signal Sdc (step S240). And the driving circuit 230 adjusts operation of power conversion according to the dimming control signal Sdc, in order to adjust the magnitude of the driving power Sdry in response to the obtained dimming message (step S250), for adjusting/changing the luminance or color temperature of the LED module LM. In this case as well, as a result, when only a small range of phase-cut angles are used to create the input power signal Pin_C, the luminance of the LED module may be affected in small part based on a direct power conversion, but may be affected in large part, and primarily, based on the control according to the output of the demodulating circuit 240, which, for example, can instruct the driving circuit 230 to perform additional dimming.

Further, in some embodiments, a way to adjust power conversion operation of a driving circuit 230 by using a dimming control signal Sdc may be an analog-signal control method. For example, the dimming control signal Sdc may be an analog signal used to control a reference value of voltage or current of the driving circuit 230 in an analog way, so as to adjust the magnitude of the driving power signal Sdry in an analog way.

While in some embodiments, a way to adjust power conversion operation of a driving circuit 230 by using a dimming control signal Sdc may be a digital-signal control method. For example, the dimming control signal Sdc may control the driving circuit to have different duty cycles corresponding to variations or values of the phase-cut angle respectively. In such embodiments, the dimming control signal Sdc may be a digital signal having a first state (as a high logical state) and a second state (as a low logical state), or may have a plurality of additional states (e.g., 8 total states). In one embodiment, the first state and the second state may be used to control the magnitude of the driving power signal Sdry of the driving circuit 230 in a digital way, such that at the first state of the dimming control signal Sdc the driving circuit 230 outputs a current while at the second state of the dimming control signal Sdc the driving circuit 230 stops outputting a current, for performing dimming of the LED module LM. If more than 2 states are used, the different states can be used to control a duty cycle of the driving power signal Sdry of the driving circuit 230.

Figure 11:
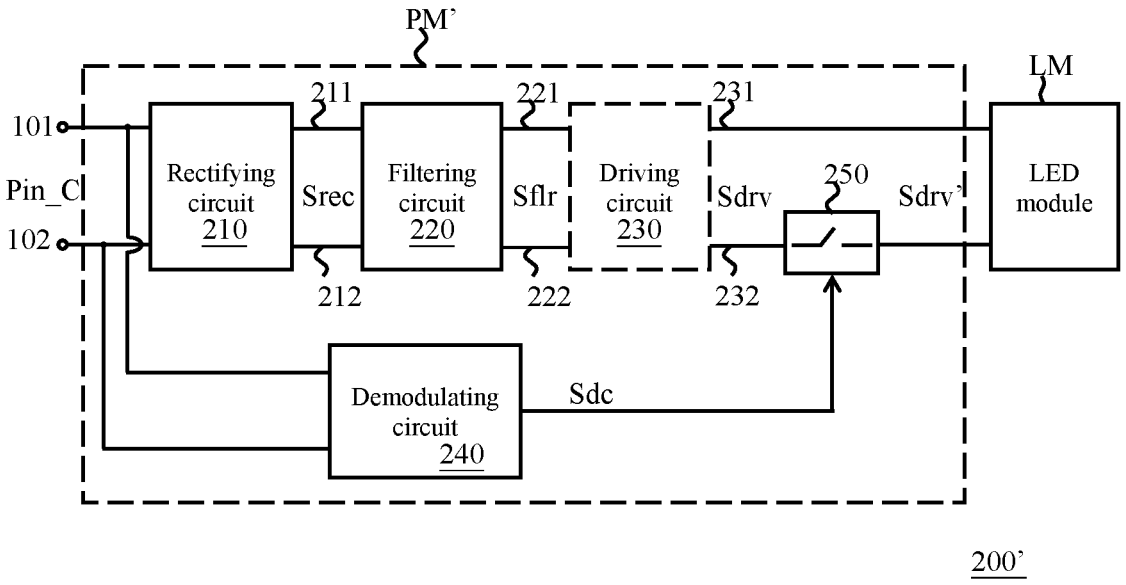
FIG. 11 is a circuit block diagram of an LED lighting apparatus according to another embodiment of the disclosure.

In some embodiments, dimming control of the LED module LM may be performed by controlling a circuit external to a driving circuit 230. For example, referring to FIG. 11, the embodiment of the LED lighting apparatus 200' shown in FIG. 11 is similar to that of FIG. 3 with a difference that in this embodiment of FIG. 11, a power supply module PM' further includes a dimming switch 250, configured for conducting or cutting off the driving power signal Sdry according to the dimming control signal Sdc so as to generate an intermittent driving power signal Sdrv' upon receiving the dimming control signal Sdc for the LED module LM, for performing dimming of the LED module LM.

Figure 12:
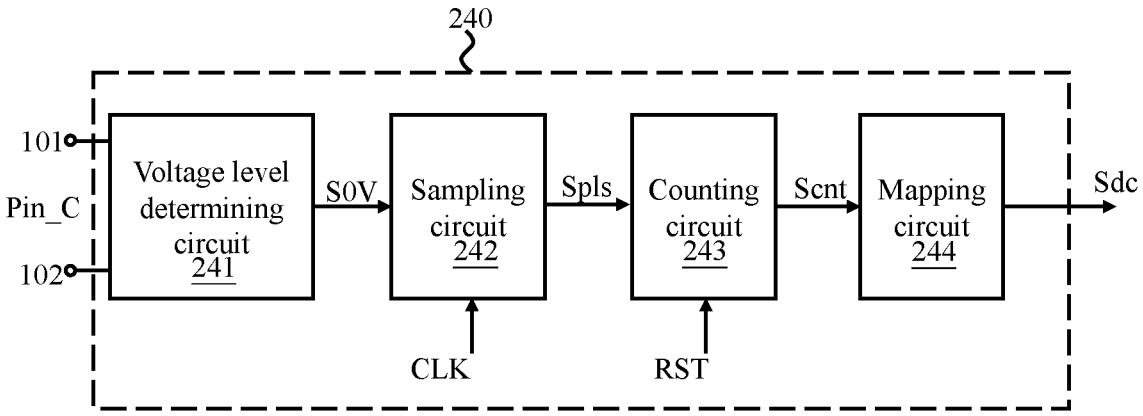
FIG. 12 is a block diagram of an embodiment of a demodulating circuit in an LED lighting apparatus according to an embodiment.
Figure 13:
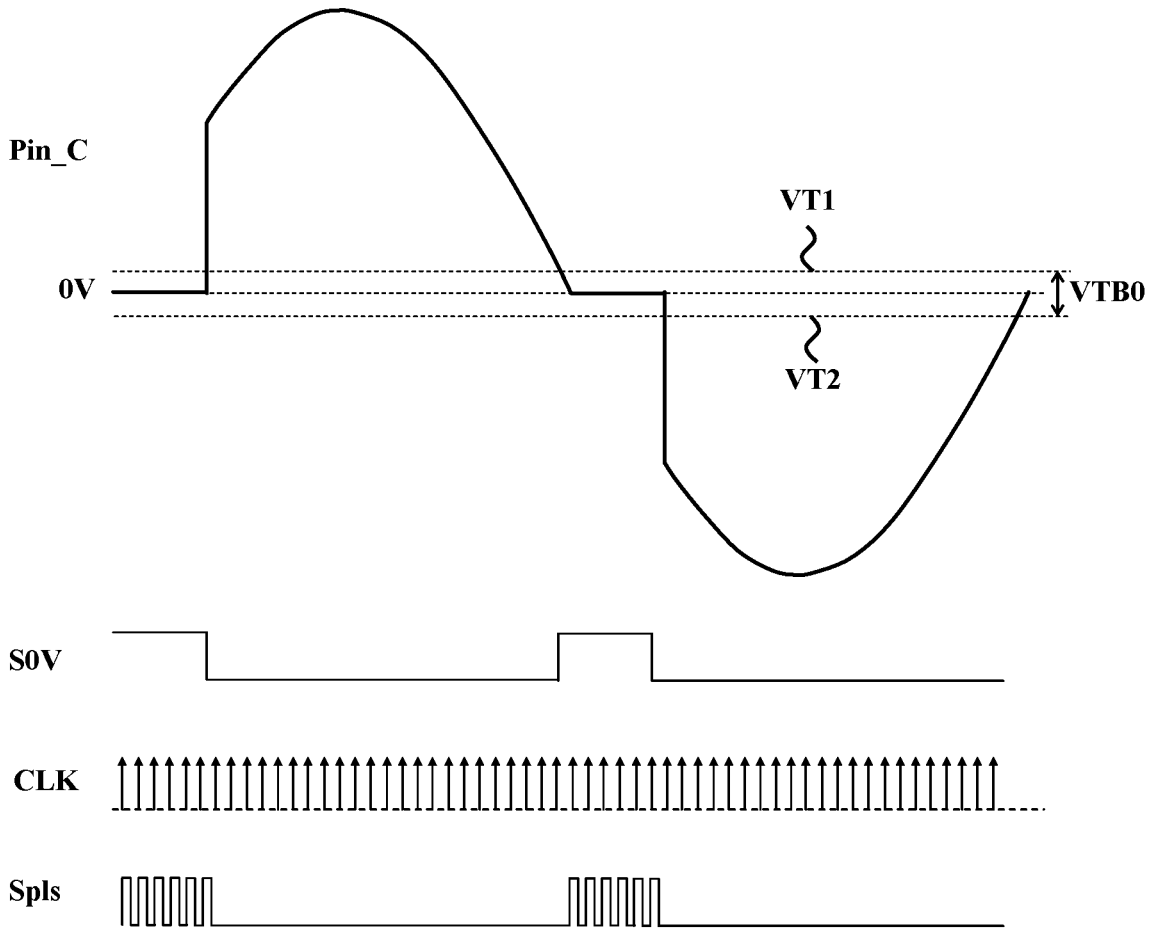
FIG. 13 illustrates correspondence between signal waveforms related to a demodulating circuit in an LED lighting apparatus according to an embodiment.

FIG. 12 is a block diagram of an embodiment of a demodulating circuit (such as the demodulating circuit 240 described herein) in an LED lighting apparatus according to an embodiment. FIG. 13 illustrates correspondence between signal waveforms related to a demodulating circuit in an LED lighting apparatus according to an embodiment. Referring to both FIGS. 12 and 13, a demodulating circuit 240 in FIG. 12 includes a voltage level determining circuit 241, a sampling circuit 242, a counting circuit 243, and a mapping circuit 244. The voltage level determining circuit 241 is configured to detect whether (the value or level of) the input power signal Pin_C is in a range of threshold values in order to determine whether the input power signal Pin_C is at a certain voltage level (e.g., zero voltage level). Specifically, as shown in FIG. 13, in some embodiments, the voltage level determining circuit 241 compares the voltage level of the input power signal Pin_C with an upper threshold value Vt1 and a lower threshold value Vt2, in order to determine whether the input power signal Pin_C is in the range of threshold values VTB0. When the input power signal Pin_C is in the range of threshold values VTB0, the voltage level determining circuit 241 outputs a corresponding voltage determination signal S0V having a first logical level (such as a high logical level) to indicate that the input power signal Pin_C is in the range of threshold values VTB0. The sampling circuit 242 is configured to sample the voltage determination signal S0V according to a clock signal CLK, in order to generate a sample signal Spls that may have pulse(s). The sampling may be performed as synchronized with the clock signal CLK. Upon the sampling, as shown in FIG. 13, when the sampled voltage determination signal S0V has or is at a high logical level indicating that the input power signal Pin_C is in the range of threshold values VTB0, the sample signal Spls outputs or presently has one or more pulses. Then, the counting circuit 243 counts the number of pulses on the sample signal Spls, such as during a half (or ½) signal cycle of the input power signal Pin, which is, for example, a sinusoidal voltage signal with frequency of 50 Hz or 60 Hz, in order to generate a counting signal Scnt, and the mapping circuit 244 maps the counting signal Scnt into a dimming control signal (such as the above-described dimming control signal Sdc), based on for example the ratio of the counting signal Scnt (indicative of the number of pulses on the sample signal Spls) to the total number of pulses or impulses on the clock signal CLK during the half signal cycle of the input power signal Pin. In this case, a resetting signal RST in FIG. 13 may be synchronized with the half signal cycle of the input power signal Pin in order to reset the counting circuit 243.

It should be noted that, the dimming control signal Sdc, as described in FIG. 3 or FIG. 4, does not transmit on the power loop which the driving power signal passes through. For example, the dimming control signal Sdc is not used for driving the LED module directly. From another perspective, the current intensity or the power level of the dimming control signal Sdc is much less than the driving power signal Sdrv. In some embodiments, the current intensity or the power level of the driving power signal Sdry is at least 10 times larger than the dimming control signal Sdc.

It should be noted that, although the described embodiments in this disclosure related to modulating the input power to result in a phase cut-off or conduction angle all use the leading edge phase cutting (meaning the phase cutting of the input power signal starts from the phase of 0 degree) for example, the disclosed invention is not limited to this type of phase cutting. In some embodiments, the dimmer can instead use the trailing edge phase cutting, i.e. the phase cutting of the input power signal starts from a particular positive phase to the phase of 180 degrees, as a way to modulate the input power.

It should also be noted that, although the described embodiments in this disclosure all aim to adjust the luminance of the lighting LED module, the described methods in these embodiments can be adapted or analogized for adjusting the color temperature of the lighting LED module. For example, if the described way of dimming control is used for adjusting the driving power for the red-light LED chips, i.e. only the luminance of these red-light LED chips in the LED lighting apparatus is adjusted, the described way of dimming control can achieve the adjusting of color temperature of the LED lighting apparatus.

According to the design of the rectifying circuit in the power supply module, there may be a dual rectifying circuit. First and second rectifying circuits of the dual rectifying circuit are respectively coupled to the two end caps disposed on two ends of the LED apparatus. The dual rectifying circuit is applicable to the drive architecture of dual-end power supply.

The dual rectifying circuit may comprise, for example, two half-wave rectifier circuits, two full-wave bridge rectifying circuits or one half-wave rectifier circuit and one full-wave bridge rectifying circuit.

According to the design of the pin in the LED apparatus, there may be two pins in a single end (the other end has no pin), two pins in corresponding ends of two ends, or four pins in corresponding ends of two ends. The designs of two pins in single end and two pins in corresponding ends of two ends are applicable to a single rectifying circuit design of the rectifying circuit. The design of four pins in corresponding ends of two ends is applicable to a dual rectifying circuit design of the rectifying circuit, and the external driving signal can be received by two pins in only one end or any pin in each of two ends.

According to the design of the filtering circuit of the power supply module, there may be a single capacitor, or π filter circuit. The filtering circuit filers the high frequency component of the rectified signal for providing a DC signal with a low ripple voltage as the filtered signal. The filtering circuit also further comprises the LC filtering circuit having a high impedance for a specific frequency for conforming to current limitations in specific frequencies of the UL standard. Moreover, the filtering circuit according to some embodiments further comprises a filtering unit coupled between a rectifying circuit and the pin(s) for reducing the EMI resulted from the circuit(s) of the LED apparatus. The LED apparatus may omit the filtering circuit in the power supply module when the external driving signal is a DC signal.

The above-mentioned exemplary features of the present invention can be accomplished in any combination to improve the LED apparatus, and the above embodiments are described by way of example only. The present invention is not herein limited, and many variations are possible without departing from the spirit of the present invention and the scope as defined in the appended claims.

What is claimed is:

1. An LED lighting apparatus configured to light in response to an input power signal, comprising:

a power supply module, configured to receive the input power signal in order to generate a driving power signal; and an LED module configured to light in response to the driving power signal, wherein the power supply module comprises:

a demodulating circuit configured to receive the input power signal and demodulate the received input power signal, in order to generate a dimming control signal for controlling luminance of the LED module, wherein the demodulating circuit demodulates the input power signal based on a phase-cut angle of the input power signal, and within a default range of the phase-cut angle that permits adjustment of the luminance of the LED module between a maximum luminance value and a minimum luminance value, a total harmonic distortion of the power supply module is smaller than 25% and a power factor of the power supply module is larger than 0.9.

2. The LED lighting apparatus according to claim 1, wherein the demodulating circuit is configured to obtain a dimming message corresponding to the phase-cut angle, and then to generate the dimming control signal according to the dimming message.

3. The LED lighting apparatus according to claim 1, wherein a phase-cut angle of the input power signal smaller than 90 degrees causes the LED module to reach a minimum luminance.

4. The LED lighting apparatus according to claim 3, wherein the phase-cut angle of the input power signal being smaller than 45 degrees causes the LED module to reach the minimum luminance.

5. The LED lighting apparatus according to claim 1, wherein a phase-cut angle selected from one of the ranges of between 0 and 45 degrees, between 5 and 45 degrees, between 5 and 20 degrees, between 15 and 20 degrees, and between 15 and 45 degrees causes the LED module to be dimmed to have a minimum luminance.

6. The LED lighting apparatus according to claim 1, wherein a dimming level of the LED module is correlated to the phase-cut angle.

7. The LED lighting apparatus according to claim 6, wherein the dimming level of the LED module is not substantially affected by changes in the peak voltage of the input power signal.

8. The LED lighting apparatus according to claim 6, wherein the dimming level of the LED module is not substantially affected by an effective value of the input power signal.

9. The LED lighting apparatus according to claim 6, wherein the dimming level of the LED module is not directly proportional to an effective value of the input power signal.

10. The LED lighting apparatus according to claim 9, wherein the effective value refers to root-means-square (RMS) value.

11. The LED lighting apparatus according to claim 9, wherein a scope ratio of the effective value of the input power signal used to adjust luminance of the LED module between a maximum luminance value and a minimum luminance value is smaller than a scope ratio of the luminance of the LED module, wherein the scope ratio of the effective value refers to the ratio of the maximum value to the minimum value of the effective value of the input power signal, and the scope ratio of the luminance refers to the ratio of the maximum luminance value to the minimum luminance value.

12. The LED lighting apparatus according to claim 11, wherein the input power signal is a modulated input power signal and the scope ratio of the effective value of the modulated input power signal used to adjust luminance of the LED module between the maximum luminance value and the minimum luminance value is smaller than or equal to 2, and the scope ratio of the luminance of the LED module is larger than or equal to 10.

13. The LED lighting apparatus according to claim 11, wherein the scope ratio of the luminance of the LED module is larger than or equal to 10.

14. The LED lighting apparatus according to claim 9, wherein the luminance of the LED module is negative correlated to the phase-cut angle of the input power signal.

15. The LED lighting apparatus according to claim 9, wherein the dimming control signal is a signal having a voltage level, and the luminance of the LED module is in negative correlation with the voltage level of the dimming control signal.

16. The LED lighting apparatus according to claim 1, wherein the dimming control signal is a signal having a voltage level, and the voltage level of the dimming control signal is in positive correlation with the phase-cut angle.

17. The LED lighting apparatus according to claim 1, wherein the total harmonic distortion of the power supply module is smaller than 25% when the phase-cut angle of the input power signal corresponds to a minimum luminance.

18. The LED lighting apparatus according to claim 1, wherein the power factor of the power supply module is larger than 0.9 when the phase-cut angle of the input power signal corresponds to a minimum luminance.

19. The LED lighting apparatus according to claim 1, wherein the demodulating circuit is configured to demodulate the phase-cut angle by counting for a period, and sampling the input power signal within the period, and is configured to generate the dimming control signal according to the demodulated phase-cut angle.

20. The LED lighting apparatus according to claim 19, wherein the demodulating circuit comprises:

a voltage level determining circuit configured to detect whether the input power signal is in a range of threshold values in order to determine whether the input power is at a predetermined voltage level and generate a corresponding voltage determination signal to indicate whether the input power signal is in the range of threshold values;

a sampling circuit configured to sample the voltage determination signal according to a clock signal, in order to generate a sample signal having pulse waveform;

a counting circuit configured to count the number of pulses on the sample signal during a signal cycle of the input power signal, in order to generate a counting signal; and a mapping circuit configured to map the counting signal into the dimming control signal.

21. The LED lighting apparatus according to claim 1, wherein the LED lighting apparatus is configured to perform either analog dimming or digital dimming of the LED module based on the dimming control signal.

22. The LED lighting apparatus according to claim 21, wherein the analog dimming is current-controlled dimming.

23. The LED lighting apparatus according to claim 21, wherein the digital dimming is pulse-width modulation-controlled dimming.

24. The LED lighting apparatus according to claim 1, wherein the dimming control signal has a default number of different signal states corresponding to the phase-cut angle, in order to control dimming of the LED module to a default number of different dimming levels respectively.

25. The LED lighting apparatus according to claim 1, wherein the power supply module further comprises:

a rectifying circuit configured to rectify the input power signal to produce a rectified signal; and a filtering circuit coupled to the rectifying circuit and configured to electrically filter the rectified signal to produce a filtered signal.

26. The LED lighting apparatus according to claim 25, wherein the power supply module further comprises a dimming switch configured for conducting or cutting off the driving power signal according to the dimming control signal, for dimming of the LED module.

27. The LED lighting apparatus according to claim 25, wherein the power supply module further comprises:

a driving circuit coupled to the filtering circuit and configured to perform power conversion on the filtered signal to produce the driving power signal.

28. The LED lighting apparatus according to claim 27, wherein the driving circuit is configured to adjust its operation of power conversion according to the dimming control signal, in order to adjust the magnitude of the driving power signal in response to the dimming control signal.

29. The LED lighting apparatus according to claim 27, wherein the driving circuit includes a power switch and an energy storage circuit; the power switch is configured to control switching between operations of the energy storage circuit for performing power conversion on the filtered signal, in order to produce the driving power signal; and the power switch is configured to adjust the magnitude of the driving power signal in response to the dimming control signal, for dimming of the LED module.

30. The LED lighting apparatus according to claim 1, wherein the input power signal is phase cut from a leading-edge or a trailing-edge to form the phase-cut angle.

31. The LED lighting apparatus according to claim 1, wherein the dimming control signal does not transmit in a power loop through which the driving power signal passes.

32. An LED lighting system, comprising:

a dimmer configured to receive an input power signal from an external power grid, and configured to modulate the input power signal to result in a phase-cut angle according to a dimming signal, in order to produce a dimmer-adjusted input power signal; and an LED lighting apparatus according to claim 1 and configured to receive the dimmer-adjusted input power signal and to be driven to emit light according to the dimmer-adjusted input power signal.

33. The LED lighting system according to claim 32, wherein the dimmer includes a controllable electronic element configured to adjust the phase-cut angle in response to the dimming signal in order to produce the modulated input power signal, wherein the controllable electronic element comprises a bidirectional triode thyristor, a single-chip microcomputer, or a transistor.

34. An LED lighting apparatus, comprising a rectifying circuit, a filtering circuit, a driving circuit, an LED module, and a demodulating circuit, wherein:

the rectifying circuit is configured to receive an input power signal through first and second connection terminals, in order to rectify the input power signal and then output a rectified signal;

the filtering circuit is coupled to the rectifying circuit, in order to electrically filter the rectified signal to produce a filtered signal;

the driving circuit is coupled to the filtering circuit, in order to perform power conversion on the filtered signal to produce a driving power signal;

the LED module is coupled to the driving circuit and is configured to light up and emit light according to the driving power signal;

the demodulating circuit is directly connected to the first and second connection terminals, and is configured to obtain a signal feature of the input power signal and then demodulate the signal feature in order to obtain a corresponding dimming message;

the demodulating circuit is configured to generate a dimming control signal according to the obtained dimming message and then provide the dimming control signal for the driving circuit; and the driving circuit is configured to adjust its operation of power conversion according to the received dimming control signal, in order to change or adjust the magnitude of the driving power signal in response to the dimming message.

35. The LED lighting apparatus according to claim 34, wherein the signal feature is a phase-cut angle of the input power signal, and wherein the phase-cut angle is not larger than 90 degrees when the LED module lights up with a minimum luminance.

36. The LED lighting apparatus according to claim 35, wherein the demodulating circuit is configured to obtain a dimming message corresponding to the phase-cut angle, and then to generate the dimming control signal according to the dimming message.

37. The LED lighting apparatus according to claim 34, wherein the signal feature is a phase-cut angle of the input power signal, and wherein a phase-cut angle selected from one of the ranges of between 0 and 45 degrees, between 5 and 45 degrees, between 5 and 20 degrees, between 15 and 20 degrees, and between 15 and 45 degrees causes the LED module to be dimmed to have a minimum luminance.

38. The LED lighting apparatus according to claim 35, wherein a dimming level of the LED module is correlated to the phase-cut angle.

39. The LED lighting apparatus according to claim 38, wherein the dimming level of the LED module is not substantially affected by changes in the peak voltage of the input power signal.

40. The LED lighting apparatus according to claim 38, wherein within a default phase range of the phase-cut angle that permits adjustment of the luminance of the LED module between the maximum luminance value and the minimum luminance value, a total harmonic distortion of the driving circuit is smaller than 25% and/or the power factor of the driving circuit is larger than 0.9.

41. The LED lighting apparatus according to claim 38, wherein the dimming level of the LED module is not directly proportional to an effective value of the input power signal.

42. The LED lighting apparatus according to claim 34, wherein a scope ratio of the effective value of the input power signal used to adjust luminance of the LED module between a maximum luminance value and a minimum luminance value is smaller than a scope ratio of the luminance of the LED module, wherein the scope ratio of the effective value refers to the ratio of the maximum value to the minimum value of the effective value of the input power signal, and the scope ratio of the luminance refers to the ratio of the maximum luminance value to the minimum luminance value.

43. The LED lighting apparatus according to claim 42, wherein the input power signal is a modulated input power signal and the scope ratio of the effective value of the modulated input power signal used to adjust luminance of the LED module between the maximum luminance value and the minimum luminance value is smaller than or equal to 2, and the scope ratio of the luminance of the LED module is larger than or equal to 10.

44. An LED lighting apparatus configured to light in response to an input power signal, comprising:

a power supply module, configured to receive the input power signal in order to generate a driving power signal; and an LED module configured to light in response to the driving power signal;

wherein the power supply module comprises:

a demodulating circuit configured to receive the input power signal and demodulate the received input power signal, in order to generate a dimming control signal for controlling luminance of the LED module;

wherein the demodulating circuit demodulates the input power signal based on a phase-cut angle of the input power signal, and a default range of the phase-cut angle that permits adjustment of the luminance of the LED module between a maximum luminance value and a minimum luminance value, a total harmonic distortion and power factor of the power supply module can be maintained and wherein the total harmonic distortion of the power supply module is smaller than 25% and the power factor of the power supply module is larger than 0.9.

45. The LED lighting apparatus according to claim 44, wherein the total harmonic distortion of the power supply module is smaller than 25% when the phase-cut angle of the input power signal corresponds to a minimum luminance.

46. The LED lighting apparatus according to claim 44, wherein the power factor of the power supply module is larger than 0.9 when the phase-cut angle of the input power signal corresponds to a minimum luminance.

* * * * *